US010156378B2

(12) United States Patent
Alsaleem

(10) Patent No.: US 10,156,378 B2
(45) Date of Patent: Dec. 18, 2018

(54) HVAC SYSTEM REMOTE MONITORING AND DIAGNOSIS OF REFRIGERANT LINE OBSTRUCTION

(71) Applicant: EMERSON CLIMATE TECHNOLOGIES, INC., Sidney, OH (US)

(72) Inventor: Fadi M. Alsaleem, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 648 days.

(21) Appl. No.: 14/713,308

(22) Filed: May 15, 2015

(65) Prior Publication Data

US 2015/0345821 A1 Dec. 3, 2015

Related U.S. Application Data

(60) Provisional application No. 62/004,442, filed on May 29, 2014.

(51) Int. Cl.
*F24F 11/30* (2018.01)
*F24F 11/00* (2018.01)
(Continued)

(52) U.S. Cl.
CPC ..... *F24F 11/0086* (2013.01); *F24F 11/30* (2018.01); *F25B 49/005* (2013.01);
(Continued)

(58) Field of Classification Search
CPC ..... G01K 7/02; G01K 3/005; G01K 3/10; G01K 7/42; G01K 7/22; G01K 13/02;
(Continued)

(56) References Cited

U.S. PATENT DOCUMENTS

2011/0093424 A1 4/2011 Zimmermann et al.
2013/0099011 A1 4/2013 Matsuoka et al.

FOREIGN PATENT DOCUMENTS

EP 1657505 A1 5/2006
EP 1731857 A1 12/2006
(Continued)

OTHER PUBLICATIONS

International Search Report regarding International Patent Application No. PCT/US2015/031383, dated Aug. 12, 2015.
(Continued)

*Primary Examiner* — Manish S Shah
(74) *Attorney, Agent, or Firm* — Harness, Dickey & Pierce, P.L.C.

(57) ABSTRACT

A heating, ventilation, and air conditioning (HVAC) system of a building includes a refrigerant loop. A monitoring system for the HVAC system includes a monitoring device installed at the building. The monitoring device is configured to measure a first temperature of refrigerant in a refrigerant line located between a filter-drier of the refrigerant loop and an expansion valve of the refrigerant loop. The monitoring system includes a monitoring server, located remotely from the building. The monitoring server is configured to receive the first temperature and, in response to the first temperature being less than a threshold, generate a refrigerant line restriction advisory. The monitoring server is configured to, in response to the refrigerant line restriction advisory, selectively generate an alert for transmission to at least one of a customer and an HVAC contractor.

25 Claims, 12 Drawing Sheets

(51) Int. Cl.
*F25B 49/00* (2006.01)
*F25B 13/00* (2006.01)

(52) U.S. Cl.
CPC ..... *F25B 13/00* (2013.01); *F25B 2313/0314* (2013.01); *F25B 2500/19* (2013.01); *F25B 2600/07* (2013.01); *F25B 2700/2104* (2013.01); *F25B 2700/2106* (2013.01); *F25B 2700/21151* (2013.01); *F25B 2700/21163* (2013.01)

(58) Field of Classification Search
CPC ..... G01K 2205/04; G01K 7/16; G01K 7/10; G01K 11/32; G01K 13/00; G01K 2013/024; H01R 4/023; H01R 4/029; H01R 43/28; B23K 31/02; G01F 1/00; G01N 25/72; G01N 25/28; G01N 25/32; G01N 33/225; G01N 32/02; H05K 7/20945; F24F 11/0012; F24F 2001/0052; F24F 2011/0093; F24F 11/022; H02M 1/32; H02M 1/38; H02M 1/53806; H01C 7/008; H01C 17/00; G01R 31/2642; G01R 31/048; G01R 31/40; G01J 5/004; G01J 5/043; G01J 5/0821; A47J 43/287; F16B 2/02; F16B 1/00; F16B 47/00; F16B 2001/0035; F16M 13/02; F16M 13/022
See application file for complete search history.

(56) References Cited

FOREIGN PATENT DOCUMENTS

| | | | | | |
|---|---|---|---|---|---|
| JP | 2006052928 | A | | 2/2006 | |
| JP | 2013124794 | A | * | 6/2013 | ..... F24F 11/02 |
| JP | 2013124794 | A | | 6/2013 | |
| KR | 20130130513 | A | | 12/2013 | |

OTHER PUBLICATIONS

Written Opinion of the International Searching Authority regarding International Patent Application No. PCT/US2015/031383, dated Aug. 12, 2015.
Extended European Search Report regarding European Application No. 15799976 dated Apr. 23, 2018.
European Search Report Application No. 15799976.4 PCT/US2015031383 dated Jan. 22, 2018.

* cited by examiner

HVAC SYSTEM REMOTE MONITORING AND DIAGNOSIS OF REFRIGERANT LINE OBSTRUCTION

CROSS-REFERENCE TO RELATED APPLICATIONS

This application claims the benefit of U.S. Provisional Application No. 62/004,442, filed on May 29, 2014. The entire disclosure of the application referenced above is incorporated herein by reference.

FIELD

The present disclosure relates to environmental comfort systems and more particularly to remote monitoring and diagnosis of residential and light commercial environmental comfort systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A residential or light commercial HVAC (heating, ventilation, or air conditioning) system controls environmental parameters, such as temperature and humidity, of a building. The target values for the environmental parameters, such as a temperature set point, may be specified by a user or owner of the building, such as an employee working in the building or a homeowner.

In FIG. 1, a block diagram of an example HVAC system is presented. In this particular example, a forced air system with a gas furnace is shown. Return air is pulled from the building through a filter 104 by a circulator blower 108. The circulator blower 108, also referred to as a fan, is controlled by a control module 112. The control module 112 receives signals from a thermostat 116. For example only, the thermostat 116 may include one or more temperature set points specified by the user.

The thermostat 116 may direct that the circulator blower 108 be turned on at all times or only when a heat request or cool request is present (automatic fan mode). In various implementations, the circulator blower 108 can operate at multiple speeds or at any speed within a predetermined range. One or more switching relays (not shown) may be used to control the circulator blower 108 and/or to select a speed of the circulator blower 108.

The thermostat 116 provides the heat and/or cool requests to the control module 112. When a heat request is made, the control module 112 causes a burner 120 to ignite. Heat from combustion is introduced to the return air provided by the circulator blower 108 in a heat exchanger 124. The heated air is supplied to the building and is referred to as supply air.

The burner 120 may include a pilot light, which is a small constant flame for igniting the primary flame in the burner 120. Alternatively, an intermittent pilot may be used in which a small flame is first lit prior to igniting the primary flame in the burner 120. A sparker may be used for an intermittent pilot implementation or for direct burner ignition. Another ignition option includes a hot surface igniter, which heats a surface to a high enough temperature that, when gas is introduced, the heated surface initiates combustion of the gas. Fuel for combustion, such as natural gas, may be provided by a gas valve 128.

The products of combustion are exhausted outside of the building, and an inducer blower 132 may be turned on prior to ignition of the burner 120. In a high efficiency furnace, the products of combustion may not be hot enough to have sufficient buoyancy to exhaust via conduction. Therefore, the inducer blower 132 creates a draft to exhaust the products of combustion. The inducer blower 132 may remain running while the burner 120 is operating. In addition, the inducer blower 132 may continue running for a set period of time after the burner 120 turns off.

A single enclosure, which will be referred to as an air handler unit 136, may include the filter 104, the circulator blower 108, the control module 112, the burner 120, the heat exchanger 124, the inducer blower 132, an expansion valve 140, an evaporator 144, and a condensate pan 146. In various implementations, the air handler unit 136 includes an electrical heating device (not shown) instead of or in addition to the burner 120. When used in addition to the burner 120, the electrical heating device may provide backup or secondary heat.

In FIG. 1, the HVAC system includes a split air conditioning system. Refrigerant is circulated through a compressor 148, a condenser 152, the expansion valve 140, and the evaporator 144. The evaporator 144 is placed in series with the supply air so that when cooling is desired, the evaporator 144 removes heat from the supply air, thereby cooling the supply air. During cooling, the evaporator 144 is cold, which causes water vapor to condense. This water vapor is collected in the condensate pan 146, which drains or is pumped out.

A control module 156 receives a cool request from the control module 112 and controls the compressor 148 accordingly. The control module 156 also controls a condenser fan 160, which increases heat exchange between the condenser 152 and outside air. In such a split system, the compressor 148, the condenser 152, the control module 156, and the condenser fan 160 are generally located outside of the building, often in a single condensing unit 164. A filter-drier 154 may be located between the condenser 152 and the expansion valve 140. The filter-drier 154 removes moisture and/or other contaminants from the circulating refrigerant.

In various implementations, the control module 156 may simply include a run capacitor, a start capacitor, and a contactor or relay. In fact, in certain implementations, the start capacitor may be omitted, such as when a scroll compressor instead of a reciprocating compressor is being used. The compressor 148 may be a variable-capacity compressor and may respond to a multiple-level cool request. For example, the cool request may indicate a mid-capacity call for cool or a high-capacity call for cool.

The electrical lines provided to the condensing unit 164 may include a 240 volt mains power line (not shown) and a 24 volt switched control line. The 24 volt control line may correspond to the cool request shown in FIG. 1. The 24 volt control line controls operation of the contactor. When the control line indicates that the compressor should be on, the contactor contacts close, connecting the 240 volt power supply to the compressor 148. In addition, the contactor may connect the 240 volt power supply to the condenser fan 160. In various implementations, such as when the condensing unit 164 is located in the ground as part of a geothermal system, the condenser fan 160 may be omitted. When the 240 volt mains power supply arrives in two legs, as is common in the U.S., the contactor may have two sets of contacts, and can be referred to as a double-pole single-throw switch.

Monitoring of operation of components in the condensing unit 164 and the air handler unit 136 has traditionally been performed by an expensive array of multiple discrete sensors that measure current individually for each component. For example, a first sensor may sense the current drawn by a motor, another sensor measures resistance or current flow of an igniter, and yet another sensor monitors a state of a gas valve. However, the cost of these sensors and the time required for installation of, and taking readings from, the sensors has made monitoring cost-prohibitive.

SUMMARY

A heating, ventilation, and air conditioning (HVAC) system of a building includes a refrigerant loop. A monitoring system for the HVAC system includes a monitoring device installed at the building. The monitoring device is configured to measure a first temperature of refrigerant in a refrigerant line located between a filter-drier of the refrigerant loop and an expansion valve of the refrigerant loop. The monitoring system includes a monitoring server, located remotely from the building. The monitoring server is configured to receive the first temperature and, in response to the first temperature being less than a threshold, generate a refrigerant line restriction advisory. The monitoring server is configured to, in response to the refrigerant line restriction advisory, selectively generate an alert for transmission to at least one of a customer and an HVAC contractor.

In other features, the threshold is a predefined value. In other features, the threshold is based on an ambient temperature. In other features, while the HVAC system is in a cooling mode, the ambient temperature is an outside ambient temperature. In other features, the threshold is determined by subtracting a predetermined value from the ambient temperature.

In other features, the monitoring server is further configured to generate the refrigerant line restriction advisory in response to the first temperature being less than a second threshold. The second threshold is a predefined value. In other features, the HVAC system comprises a heat pump system. The ambient temperature is an indoor ambient temperature while the HVAC system is in a heating mode. In other features, the threshold is based on a second temperature of refrigerant at a location upstream of the filter-drier in the refrigerant loop.

In other features, the monitoring server is further configured to generate the refrigerant line restriction advisory in response to a difference between the first temperature and the second temperature exceeding a second threshold. In other features, a baseline value for the difference is established and the second threshold is determined based on the baseline value. In other features, the second threshold is equal to the baseline plus a predetermined value. In other features, the alert indicates that a refrigerant line restriction has been detected.

A heating, ventilation, and air conditioning (HVAC) system of a building includes a refrigerant loop. A method of monitoring system the HVAC system includes measuring a first temperature of refrigerant in a refrigerant line located between a filter-drier of the refrigerant loop and an expansion valve of the refrigerant loop. The method includes transmitting the first temperature to a server located remotely from the building. The method includes, at the server, comparing the first temperature to a threshold. The method includes, in response to the first temperature being less than the threshold, generating a refrigerant line restriction advisory. The method includes, in response to the refrigerant line restriction advisory, selectively generating an alert for transmission to at least one of a customer and an HVAC contractor.

In other features, the threshold is a predefined value. In other features, the threshold is based on an ambient temperature. In other features, while the HVAC system is in a cooling mode, the ambient temperature is an outside ambient temperature. In other features, the threshold is determined by subtracting a predetermined value from the ambient temperature.

In other features, the method includes generating the refrigerant line restriction advisory in response to the first temperature being less than a second threshold. The second threshold is a predefined value. In other features, the HVAC system comprises a heat pump system. The ambient temperature is an indoor ambient temperature while the HVAC system is in a heating mode. In other features, the threshold is based on a second temperature of refrigerant at a location upstream of the filter-drier in the refrigerant loop.

In other features, the method includes generating the refrigerant line restriction advisory in response to a difference between the first temperature and the second temperature exceeding a second threshold. In other features, the method includes establishing a baseline value for the difference and determining the second threshold based on the baseline value. In other features, the second threshold is equal to the baseline plus a predetermined value. In other features, the alert indicates that a refrigerant line restriction has been detected.

A heating, ventilation, and air conditioning (HVAC) system of a building includes a refrigerant loop. A method of monitoring the HVAC system includes, at a monitoring server remote from the building, receiving a first refrigerant temperature. The first refrigerant temperature represents temperature of refrigerant within a refrigerant line located between a filter-drier of the refrigerant loop and an expansion valve of the refrigerant loop. The method includes receiving a second refrigerant temperature at the monitoring server. The second refrigerant temperature represents temperature of refrigerant within a refrigerant line located upstream of the filter-drier of the refrigerant loop. The method includes, in response to the first refrigerant temperature being less than a first threshold, generating a first refrigerant line restriction advisory at the monitoring server. The method includes, at the monitoring server, calculating a difference between the first refrigerant temperature and the second refrigerant temperature. The method includes, at the monitoring server, establishing a baseline value for the difference. The method includes, in response to the difference exceeding the baseline by more than a second threshold, generating a second refrigerant line restriction advisory at the monitoring server. The method includes, in response to generation of one or more of the first refrigerant line restriction advisory and the second refrigerant line restriction advisory, selectively generating an alert for transmission to at least one of a customer and an HVAC contractor.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

According to the present disclosure, a monitoring system can be integrated with a residential or light commercial HVAC (heating, ventilation, or air conditioning) system of a building. The monitoring system can provide information on the status, maintenance, and efficiency of the HVAC system to customers and/or contractors associated with the building. For example, the building may be a single-family residence, and the customer may be the homeowner, a landlord, or a tenant. In other implementations, the building may be a light commercial building, and the customer may be the building owner, a tenant, or a property management company.

As used in this application, the term HVAC can encompass all environmental comfort systems in a building, including heating, cooling, humidifying, dehumidifying, and air exchanging and purifying, and covers devices such as furnaces, heat pumps, humidifiers, dehumidifiers, and air conditioners. HVAC systems as described in this application do not necessarily include both heating and air conditioning, and may instead have only one or the other.

In split HVAC systems with an air handler unit (often, located indoors) and a condensing unit (often, located outdoors), an air handler monitor module and a condensing monitor module, respectively, can be used. The air handler monitor module and the condensing monitor module may be integrated by the manufacturer of the HVAC system, may be added at the time of the installation of the HVAC system, and/or may be retrofitted to an existing HVAC system.

Figure 1:
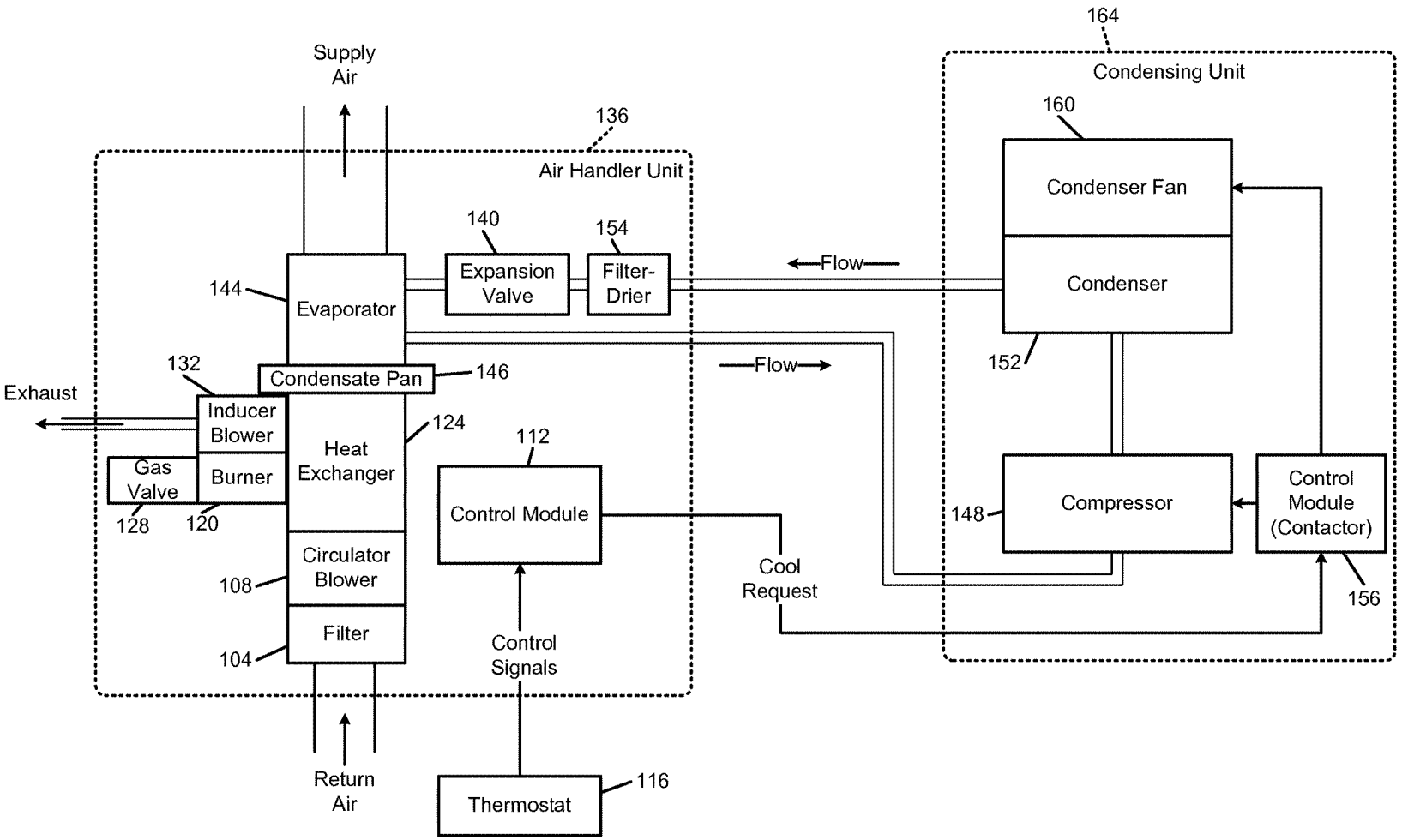
FIG. 1 Prior Art
FIG. 1 is a block diagram of an example HVAC system according to the prior art.

In heat pump systems, the function of the air handler unit and the condensing unit are reversed depending on the mode of the heat pump. As a result, although the present disclosure uses the terms air handler unit and condensing unit, the terms indoor unit and outdoor unit could be used instead in the context of a heat pump. The terms indoor unit and outdoor unit emphasize that the physical locations of the components stay the same while their roles change depending on the mode of the heat pump. A reversing valve selectively reverses the flow of refrigerant from what is shown in FIG. 1 depending on whether the system is heating the building or cooling the building. When the flow of refrigerant is reversed, the roles of the evaporator and condenser are reversed—i.e., refrigerant evaporation occurs in what is labeled the condenser while refrigerant condensation occurs in what is labeled as the evaporator.

The air handler monitor and condensing monitor modules monitor operating parameters of associated components of the HVAC system. For example, the operating parameters may include power supply current, power supply voltage, operating and ambient temperatures of inside and outside air, refrigerant temperatures at various points in the refrigerant loop, fault signals, control signals, and humidity of inside and outside air.

The principles of the present disclosure may be applied to monitoring other systems, such as a hot water heater, a boiler heating system, a refrigerator, a refrigeration case, a pool heater, a pool pump/filter, etc. As an example, the hot water heater may include an igniter, a gas valve (which may be operated by a solenoid), an igniter, an inducer blower, and a pump. The monitoring system may analyze aggregate current readings to assess operation of the individual components of the hot water heater.

The air handler monitor and condensing monitor modules may communicate data between each other, while one or both of the air handler monitor and condensing monitor modules upload data to a remote location. The remote location may be accessible via any suitable network, including the Internet.

The remote location includes one or more computers, which will be referred to as servers. The servers execute a monitoring system on behalf of a monitoring company. The monitoring system receives and processes the data from the air handler monitor and condensing monitor modules of customers who have such systems installed. The monitoring system can provide performance information, diagnostic alerts, and error messages to a customer and/or third parties, such as designated HVAC contractors.

A server of the monitoring system includes a processor and memory. The memory stores application code that processes data received from the air handler monitor and condensing monitor modules and determines existing and/or impending failures, as described in more detail below. The processor executes this application code and stores received data either in the memory or in other forms of storage, including magnetic storage, optical storage, flash memory storage, etc. While the term server is used in this application, the application is not limited to a single server.

A collection of servers may together operate to receive and process data from the air handler monitor and condensing monitor modules of multiple buildings. A load balancing algorithm may be used between the servers to distribute processing and storage. The present application is not limited to servers that are owned, maintained, and housed by a monitoring company. Although the present disclosure describes diagnostics and processing and alerting occurring in a remote monitoring system, some or all of these functions may be performed locally using installed equipment and/or customer resources, such as on a customer computer or computers.

Customers and/or HVAC contractors may be notified of current and predicted issues affecting effectiveness or efficiency of the HVAC system, and may receive notifications related to routine maintenance. The methods of notification may take the form of push or pull updates to an application, which may be executed on a smart phone or other mobile device or on a standard computer. Notifications may also be viewed using web applications or on local displays, such as on a thermostat or other displays located throughout the building or on a display (not shown) implemented in the air handler monitor module or the condensing monitor module. Notifications may also include text messages, emails, social networking messages, voicemails, phone calls, etc.

The air handler monitor and condensing monitor modules may each sense an aggregate current for the respective unit without measuring individual currents of individual components. The aggregate current data may be processed using frequency domain analysis, statistical analysis, and state machine analysis to determine operation of individual components based on the aggregate current data. This processing may happen partially or entirely in a server environment, remote from the customer's building or residence.

The frequency domain analysis may allow individual contributions of HVAC system components to be determined. Some of the advantages of using an aggregate current measurement may include reducing the number of current sensors that would otherwise be necessary to monitor each of the HVAC system components. This reduces bill of materials costs, as well as installation costs and potential installation problems. Further, providing a single time-domain current stream may reduce the amount of bandwidth necessary to upload the current data. Nevertheless, the present disclosure could also be used with additional current sensors.

Based on measurements from the air handler monitor and condensing monitor modules, the monitoring company can determine whether HVAC components are operating at their peak performance and can advise the customer and the contractor when performance is reduced. This performance reduction may be measured for the system as a whole, such as in terms of efficiency, and/or may be monitored for one or more individual components.

In addition, the monitoring system may detect and/or predict failures of one or more components of the system. When a failure is detected, the customer can be notified and potential remediation steps can be taken immediately. For example, components of the HVAC system may be shut down to prevent or minimize damage, such as water damage, to HVAC components. The contractor can also be notified that a service call will be required. Depending on the contractual relationship between the customer and the contractor, the contractor may immediately schedule a service call to the building.

The monitoring system may provide specific information to the contractor, including identifying information of the customer's HVAC system, including make and model numbers, as well as indications of the specific part numbers that appear to be failing. Based on this information, the contractor can allocate the correct repair personnel that have experience with the specific HVAC system and/or component. In addition, the service technician is able to bring replacement parts, avoiding return trips after diagnosis.

Depending on the severity of the failure, the customer and/or contractor may be advised of relevant factors in determining whether to repair the HVAC system or replace some or all of the components of the HVAC system. For example only, these factors may include relative costs of repair versus replacement, and may include quantitative or qualitative information about advantages of replacement equipment. For example, expected increases in efficiency and/or comfort with new equipment may be provided. Based on historical usage data and/or electricity or other commodity prices, the comparison may also estimate annual savings resulting from the efficiency improvement.

As mentioned above, the monitoring system may also predict impending failures. This allows for preventative maintenance and repair prior to an actual failure. Alerts regarding detected or impending failures reduce the time when the HVAC system is out of operation and allows for more flexible scheduling for both the customer and contractor. If the customer is out of town, these alerts may prevent damage from occurring when the customer is not present to detect the failure of the HVAC system. For example, failure of heat in winter may lead to pipes freezing and bursting.

Alerts regarding potential or impending failures may specify statistical timeframes before the failure is expected. For example only, if a sensor is intermittently providing bad data, the monitoring system may specify an expected amount of time before it is likely that the sensor effectively stops working due to the prevalence of bad data. Further, the monitoring system may explain, in quantitative or qualitative terms, how the current operation and/or the potential failure will affect operation of the HVAC system. This enables the customer to prioritize and budget for repairs.

For the monitoring service, the monitoring company may charge a periodic rate, such as a monthly rate. This charge may be billed directly to the customer and/or may be billed to the contractor. The contractor may pass along these charges to the customer and/or may make other arrangements, such as by requiring an up-front payment upon installation and/or applying surcharges to repairs and service visits.

For the air handler monitor and condensing monitor modules, the monitoring company or contractor may charge the customer the equipment cost, including the installation cost, at the time of installation and/or may recoup these costs as part of the monthly fee. Alternatively, rental fees may be charged for the air handler monitor and condensing monitor modules, and once the monitoring service is stopped, the air handler monitor and condensing monitor modules may be returned.

The monitoring service may allow the customer and/or contractor to remotely monitor and/or control HVAC components, such as setting temperature, enabling or disabling heating and/or cooling, etc. In addition, the customer may be able to track energy usage, cycling times of the HVAC system, and/or historical data. Efficiency and/or operating costs of the customer's HVAC system may be compared against HVAC systems of neighbors, whose buildings will be subject to the same or similar environmental conditions. This allows for direct comparison of HVAC system and overall building efficiency because environmental variables, such as temperature and wind, are controlled.

The installer can provide information to the remote monitoring system including identification of control lines that were connected to the air handler monitor module and condensing monitor module. In addition, information such as the HVAC system type, year installed, manufacturer, model number, BTU rating, filter type, filter size, tonnage, etc.

In addition, because the condensing unit may have been installed separately from the furnace, the installer may also record and provide to the remote monitoring system the manufacturer and model number of the condensing unit, the year installed, the refrigerant type, the tonnage, etc. Upon installation, baseline tests are run. For example, this may include running a heating cycle and a cooling cycle, which the remote monitoring system records and uses to identify initial efficiency metrics. Further, baseline profiles for current, power, and frequency domain current can be established.

The server may store baseline data for the HVAC system of each building. The baselines can be used to detect changes indicating impending or existing failures. For example only, frequency-domain current signatures of failures of various components may be pre-programmed, and may be updated based on observed evidence from contractors. For example, once a malfunction in an HVAC system is recognized, the monitoring system may note the frequency data leading up to the malfunction and correlate that frequency signature with frequency signatures associated with potential causes of the malfunction. For example only, a computer learning system, such as a neural network or a genetic algorithm, may be used to refine frequency signatures. The frequency signatures may be unique to different types of HVAC systems but may share common characteristics. These common characteristics may be adapted based on the specific type of HVAC system being monitored.

The installer may collect a device fee, an installation fee, and/or a subscription fee from the customer. In various implementations, the subscription fee, the installation fee, and the device fee may be rolled into a single system fee, which the customer pays upon installation. The system fee may include the subscription fee for a set number of years, such as 1, 2, 5, or 10, or may be a lifetime subscription, which may last for the life of the home or the ownership of the building by the customer.

The monitoring system can be used by the contractor during and after installation and during and after repair (i) to verify operation of the air handler monitor and condensing monitor modules, as well as (ii) to verify correct installation of the components of the HVAC system. In addition, the customer may review this data in the monitoring system for assurance that the contractor correctly installed and configured the HVAC system. In addition to being uploaded to the remote monitoring service (also referred to as the cloud), monitored data may be transmitted to a local device in the building. For example, a smartphone, laptop, or proprietary portable device may receive monitoring information to diagnose problems and receive real-time performance data. Alternatively, data may be uploaded to the cloud and then downloaded onto a local computing device, such as via the Internet from an interactive web site.

The historical data collected by the monitoring system may allow the contractor to properly specify new HVAC components and to better tune configuration, including dampers and set points of the HVAC system. The information collected may be helpful in product development and assessing failure modes. The information may be relevant to warranty concerns, such as determining whether a particular problem is covered by a warranty. Further, the information may help to identify conditions, such as unauthorized system modifications, that could potentially void warranty coverage.

Original equipment manufacturers may subsidize partially or fully the cost of the monitoring system and air handler and condensing monitor modules in return for access to this information. Installation and service contractors may also subsidize some or all of these costs in return for access to this information, and for example, in exchange for being recommended by the monitoring system. Based on historical service data and customer feedback, the monitoring system may provide contractor recommendations to customers.

Figure 2A:
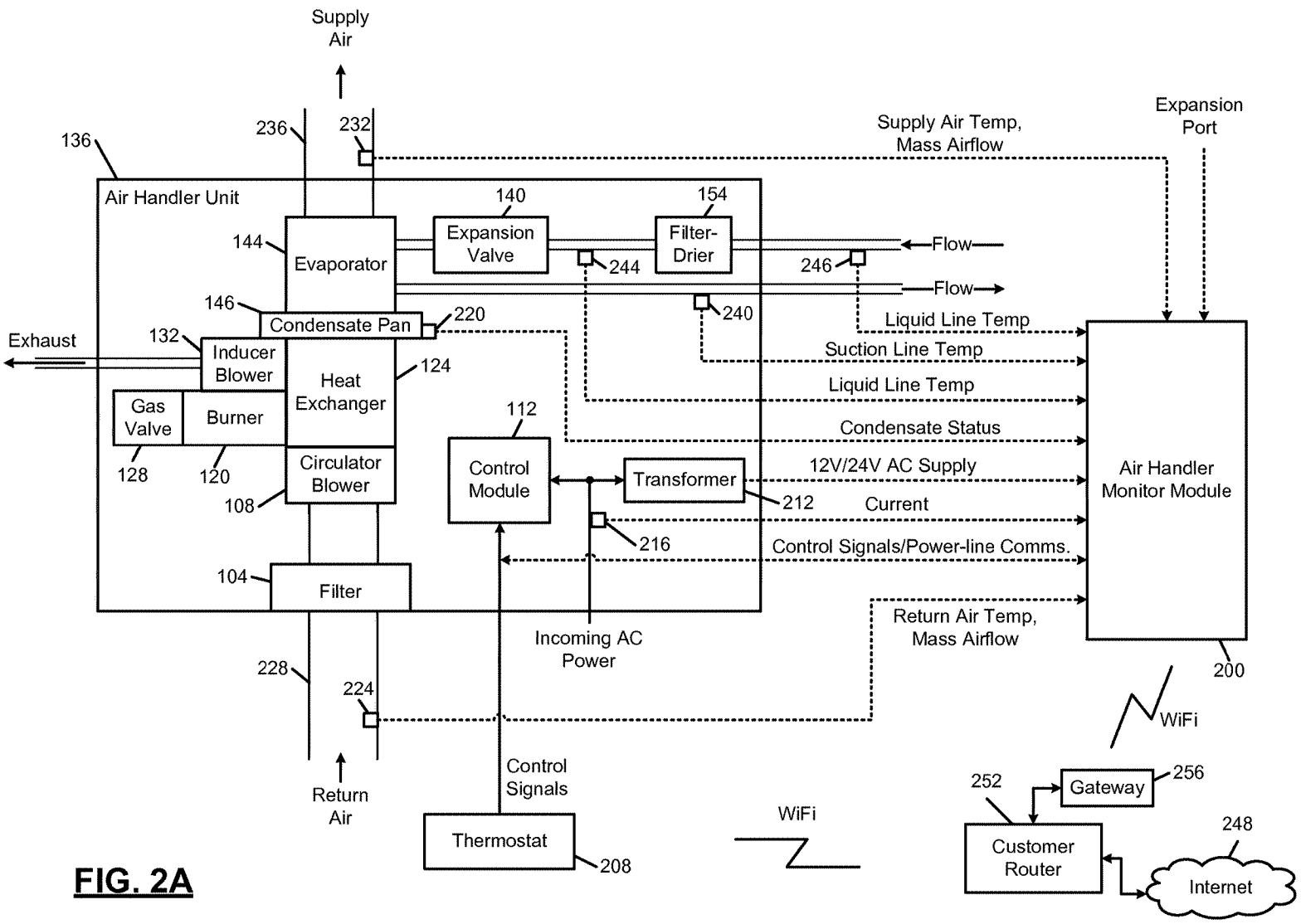
FIG. 2A is a functional block diagram of an example HVAC system including an implementation of an air handler monitor module.
Figure 2B:
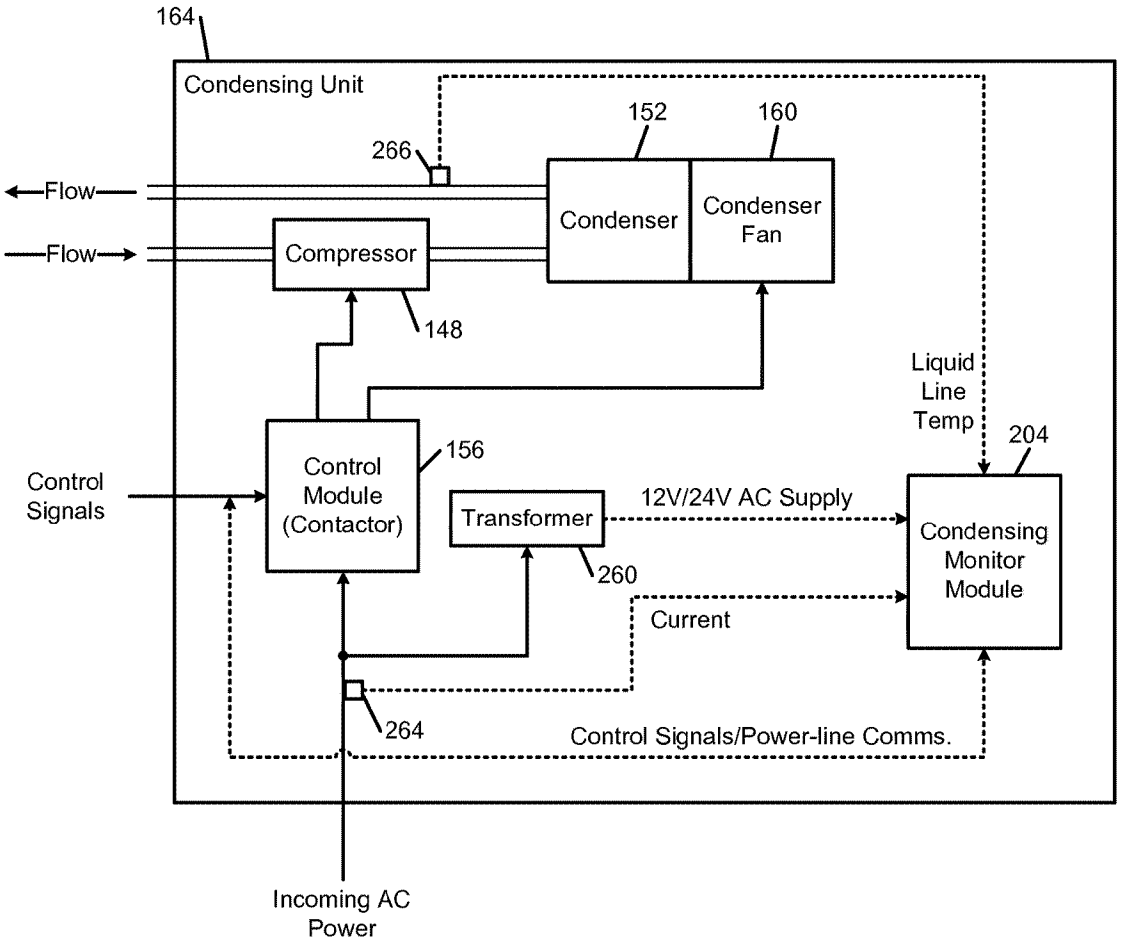
FIG. 2B is a functional block diagram of an example HVAC system including an implementation of a condensing monitor module.

FIGS. 2A-2B are functional block diagrams of an example monitoring system associated with an HVAC system of a building. The air handler unit 136 of FIG. 1 is shown for reference. Because the monitoring systems of the present disclosure can be used in retrofit applications, elements of the air handler unit 136 may remain unmodified. An air handler monitor module 200 and a condensing monitor module 204 can be installed in an existing system without needing to replace the original thermostat 116 shown in FIG. 1. To enable certain additional functionality, however, such as WiFi thermostat control and/or thermostat display of alert messages, the thermostat 116 of FIG. 1 may be replaced with a thermostat 208 having networking capability.

In many systems, the air handler unit 136 is located inside the building, while the condensing unit 164 is located outside the building. The present disclosure is not limited, and applies to other systems including, as examples only, systems where the components of the air handler unit 136 and the condensing unit 164 are located in close proximity to each other or even in a single enclosure. The single enclosure may be located inside or outside of the building. In various implementations, the air handler unit 136 may be located in a basement, garage, or attic. In ground source systems, where heat is exchanged with the earth, the air handler unit 136 and the condensing unit 164 may be located near the earth, such as in a basement, crawlspace, garage, or on the first floor, such as when the first floor is separated from the earth by only a concrete slab.

In FIG. 2A, the air handler monitor module 200 is shown external to the air handler unit 136, although the air handler monitor module 200 may be physically located outside of, in contact with, or even inside of an enclosure, such as a sheet metal casing, of the air handler unit 136.

When installing the air handler monitor module 200 in the air handler unit 136, power is provided to the air handler monitor module 200. For example, a transformer 212 can be connected to an AC line in order to provide AC power to the air handler monitor module 200. The air handler monitor module 200 may measure voltage of the incoming AC line based on this transformed power supply. For example, the transformer 212 may be a 10-to-1 transformer and therefore provide either a 12V or 24V AC supply to the air handler monitor module 200 depending on whether the air handler unit 136 is operating on nominal 120 volt or nominal 240 volt power. The air handler monitor module 200 then receives power from the transformer 212 and determines the AC line voltage based on the power received from the transformer 212.

For example, frequency, amplitude, RMS voltage, and DC offset may be calculated based on the measured voltages. In situations where 3-phase power is used, the order of the phases may be determined. Information about when the voltage crosses zero may be used to synchronize various measurements and to determine frequency of the AC power based on counting the number of zero crossings within a predetermine time period.

A current sensor 216 measures incoming current to the air handler unit 136. The current sensor 216 may include a current transformer that snaps around one power lead of the incoming AC power. The current sensor 216 may alternatively include a current shunt or a hall effect device. In various implementations, a power sensor (not shown) may be used in addition to or in place of the current sensor 216.

In various other implementations, electrical parameters (such as voltage, current, and power factor) may be measured at a different location, such as at an electrical panel providing power to the building from the electrical utility.

For simplicity of illustration, the control module 112 is not shown to be connected to the various components and sensors of the air handler unit 136. In addition, routing of the AC power to various powered components of the air handler unit 136, such as the circulator blower 108, the gas valve 128, and the inducer blower 132, are also not shown for simplicity. The current sensor 216 measures the current entering the air handler unit 136 and therefore represents an aggregate current of the current-consuming components of the air handler unit 136.

The control module 112 controls operation in response to signals from a thermostat 208 received over control lines. The air handler monitor module 200 monitors the control lines. The control lines may include a call for cool, a call for heat, and a call for fan. The control lines may include a line corresponding to a state of a reversing valve in heat pump systems.

The control lines may further carry calls for secondary heat and/or secondary cooling, which may be activated when the primary heating or primary cooling is insufficient. In dual fuel systems, such as systems operating from either electricity or natural gas, control signals related to the selection of the fuel may be monitored. Further, additional status and error signals may be monitored, such as a defrost status signal, which may be asserted when the compressor is shut off and a defrost heater operates to melt frost from an evaporator.

The control lines may be monitored by attaching leads to terminal blocks at the control module 112 at which the fan and heat signals are received. These terminal blocks may include additional connections where leads can be attached between these additional connections and the air handler monitor module 200. Alternatively, leads from the air handler monitor module 200 may be attached to the same location as the fan and heat signals, such as by putting multiple spade lugs underneath a signal screw head.

In various implementations, the cool signal from the thermostat 208 may be disconnected from the control module 112 and attached to the air handler monitor module 200. The air handler monitor module 200 can then provide a switched cool signal to the control module 112. This allows the air handler monitor module 200 to interrupt operation of the air conditioning system, such as upon detection of water by one of the water sensors. The air handler monitor module 200 may also interrupt operation of the air conditioning system based on information from the condensing monitor module 204, such as detection of a locked rotor condition in the compressor.

A condensate sensor 220 measures condensate levels in the condensate pan 146. If a level of condensate gets too high, this may indicate a plug or clog in the condensate pan 146 or a problem with hoses or pumps used for drainage from the condensate pan 146. The condensate sensor 220 may be installed along with the air handler monitor module 200 or may already be present. When the condensate sensor 220 is already present, an electrical interface adapter may be used to allow the air handler monitor module 200 to receive the readings from the condensate sensor 220. Although shown in FIG. 2A as being internal to the air handler unit 136, access to the condensate pan 146, and therefore the location of the condensate sensor 220, may be external to the air handler unit 136.

Additional water sensors, such as a conduction (wet floor) sensor may also be installed. The air handler unit 136 may be located on a catch pan, especially in situations where the air handler unit 136 is located above living space of the building. The catch pan may include a float switch. When enough liquid accumulates in the catch pan, the float switch provides an over-level signal, which may be sensed by the air handler monitor module 200.

A return air sensor 224 is located in a return air plenum 228. The return air sensor 224 may measure temperature and may also measure mass airflow. In various implementations, a thermistor may be multiplexed as both a temperature sensor and a hot wire mass airflow sensor. In various implementations, the return air sensor 224 is upstream of the filter 104 but downstream of any bends in the return air plenum 228.

A supply air sensor 232 is located in a supply air plenum 236. The supply air sensor 232 may measure air temperature and may also measure mass airflow. The supply air sensor 232 may include a thermistor that is multiplexed to measure both temperature and, as a hot wire sensor, mass airflow. In various implementations, such as is shown in FIG. 2A, the supply air sensor 232 may be located downstream of the evaporator 144 but upstream of any bends in the supply air plenum 236.

A differential pressure reading may be obtained by placing opposite sensing inputs of a differential pressure sensor (not shown) in the return air plenum 228 and the supply air plenum 236, respectively. For example only, these sensing inputs may be collocated or integrated with the return air sensor 224 and the supply air sensor 232, respectively. In various implementations, discrete pressure sensors may be placed in the return air plenum 228 and the supply air plenum 236. A differential pressure value can then be calculated by subtracting the individual pressure values.

The air handler monitor module 200 also receives a suction line temperature from a suction line temperature sensor 240. The suction line temperature sensor 240 measures refrigerant temperature in the refrigerant line between the evaporator 144 of FIG. 2A and the compressor 148 of FIG. 2B.

A liquid line temperature sensor 244 measures the temperature of refrigerant in a liquid line traveling from the condenser 152 of FIG. 2B to the expansion valve 140. When the filter-drier 154 is present, the liquid line temperature sensor 244 may be located between the filter-drier 154 and the expansion valve 140. In addition, a second liquid line temperature sensor 246 may be located in the refrigerant line prior to (i.e., upstream with respect to refrigerant flow) the filter-drier 154.

The air handler monitor module 200 may include one or more expansion ports to allow for connection of additional sensors and/or to allow connection to other devices, such as a home security system, a proprietary handheld device for use by contractors, or a portable computer.

The air handler monitor module 200 also monitors control signals from the thermostat 208. Because one or more of these control signals is also transmitted to the condensing unit 164 of FIG. 2B, these control signals can be used for communication between the air handler monitor module 200 and the condensing monitor module 204 of FIG. 2B.

The air handler monitor module 200 may transmit frames of data corresponding to periods of time. For example only, 7.5 frames may span one second (i.e., 0.1333 seconds per frame). Each frame of data may include voltage, current, temperatures, control line status, and water sensor status. Calculations may be performed for each frame of data, including averages, powers, RMS, and FFT. Then the frame is transmitted to the monitoring system.

The voltage and current signals may be sampled by an analog-to-digital converter at a certain rate, such as 1920 samples per second. The frame length may be measured in terms of samples. When a frame is 256 samples long, at a sample rate of 1920 samples per second, there will be 7.5 frames per second.

The sampling rate of 1920 Hz has a Nyquist frequency of 960 Hz and therefore allows an FFT bandwidth of up to approximately 960 Hz. An FFT limited to the time span of a single frame may be calculated for each frame. Then, for that frame, instead of transmitting all of the raw current data, only statistical data (such as average current) and frequency-domain data are transmitted.

This gives the monitoring system current data having a 7.5 Hz resolution, and gives frequency-domain data with approximately the 960 Hz bandwidth. The time-domain current and/or the derivative of the time-domain current may be analyzed to detect impending or existing failures. In addition, the current and/or the derivative may be used to determine which set of frequency-domain data to analyze. For example, certain time-domain data may indicate the approximate window of activation of a hot surface igniter, while frequency-domain data is used to assess the state of repair of the hot surface igniter.

In various implementations, the air handler monitor module 200 may only transmit frames during certain periods of time. These periods may be critical to operation of the HVAC system. For example, when thermostat control lines change, the air handler monitor module 200 may record data and transmit frames for a predetermined period of time after that transition. Then, if the HVAC system is operating, the air handler monitor module 200 may intermittently record data and transmit frames until operation of the HVAC system has completed.

The air handler monitor module 200 transmits data measured by both the air handler monitor module 200 itself and the condensing monitor module 204 over a wide area network 248, such as the Internet (referred to as the Internet 248). The air handler monitor module 200 may access the Internet 248 using a router 252 of the customer. The customer router 252 may already be present to provide Internet access to other devices (not shown) within the building, such as a customer computer and/or various other devices having Internet connectivity, such as a DVR (digital video recorder) or a video gaming system.

The air handler monitor module 200 communicates with the customer router 252 using a proprietary or standardized, wired or wireless protocol, such as Bluetooth, ZigBee (IEEE 802.15.4), 900 Megahertz, 2.4 Gigahertz, WiFi (IEEE 802.11). In various implementations, a gateway 256 is implemented, which creates a wireless network with the air handler monitor module 200. The gateway 256 may interface with the customer router 252 using a wired or wireless protocol, such as Ethernet (IEEE 802.3).

The thermostat 208 may also communicate with the customer router 252 using WiFi. Alternatively, the thermostat 208 may communicate with the customer router 252 via the gateway 256. In various implementations, the air handler monitor module 200 and the thermostat 208 do not communicate directly. However, because they are both connected through the customer router 252 to a remote monitoring system, the remote monitoring system may allow for control of one based on inputs from the other. For example, various faults identified based on information from the air handler monitor module 200 may cause the remote monitoring system to adjust temperature set points of the thermostat 208 and/or display warning or alert messages on the thermostat 208.

In various implementations, the transformer 212 may be omitted, and the air handler monitor module 200 may include a power supply that is directly powered by the incoming AC power. Further, power-line communications may be conducted over the AC power line instead of over a lower-voltage HVAC control line.

In various implementations, the current sensor 400 may be omitted, and instead a voltage sensor (not shown) may be used. The voltage sensor measures the voltage of an output of a transformer internal to the control module 112, the internal transformer providing the power (e.g., 24 Volts) for the control signals. The air handler monitor module 200 may measure the voltage of the incoming AC power and calculate a ratio of the voltage input to the internal transformer to the voltage output from the internal transformer. As the current load on the internal transformer increases, the impedance of the internal transformer causes the voltage of the output power to decrease. Therefore, the current draw from the internal transformer can be inferred from the measured ratio (also called an apparent transformer ratio). The inferred current draw may be used in place of the measured aggregate current draw described in the present disclosure.

In FIG. 2B, the condensing monitor module 204 is installed in the condensing unit 164. A transformer 260 converts incoming AC voltage into a stepped-down voltage for powering the condensing monitor module 204. In various implementations, the transformer 260 may be a 10-to-1 transformer. A current sensor 264 measures current entering the condensing unit 164. The condensing monitor module 204 may also measure voltage from the supply provided by the transformer 260. Based on measurements of the voltage and current, the condensing monitor module 204 may calculate power and/or may determine power factor.

A liquid line temperature sensor 266 measures the temperature of refrigerant traveling from the condenser 152 to the air handler unit 136. In various implementations, the liquid line temperature sensor 266 is located prior to any filter-drier, such as the filter-drier 154 of FIG. 2A. In normal operation, the liquid line temperature sensor 266 and the liquid line temperature sensor 246 of FIG. 2A may provide similar data, and therefore one of the liquid line temperature sensors 246 or 266 may be omitted. However, having both of the liquid line temperature sensors 246 and 266 may allow for certain problems to be diagnosed, such as a kink or other restriction in the refrigerant line between the air handler unit 136 and the condensing unit 164.

In various implementations, the condensing monitor module 204 may receive ambient temperature data from a temperature sensor (not shown). When the condensing monitor module 204 is located outdoors, the ambient temperature represents an outside ambient temperature. The temperature sensor supplying the ambient temperature may be located outside of an enclosure of the condensing unit 164. Alternatively, the temperature sensor may be located within the enclosure, but exposed to circulating air. In various implementations the temperature sensor may be shielded from direct sunlight and may be exposed to an air cavity that is not directly heated by sunlight. Alternatively or additionally, online (including Internet-based) weather data based on geographical location of the building may be used to determine sun load, outside ambient air temperature, precipitation, and humidity.

In various implementations, the condensing monitor module 204 may receive refrigerant temperature data from refrigerant temperature sensors (not shown) located at various points, such as before the compressor 148 (referred to as a suction line temperature), after the compressor 148 (referred to as a compressor discharge temperature), after the condenser 152 (referred to as a liquid line out temperature), and/or at one or more points along a coil of the condenser 152. The location of temperature sensors may be dictated by a physical arrangement of the condenser coils. Additionally or alternatively to the liquid line out temperature sensor, a liquid line in temperature sensor may be used. An approach temperature may be calculated, which is a measure of how close the condenser 152 has been able to bring the liquid line out temperature to the ambient air temperature.

During installation, the location of the temperature sensors may be recorded. Additionally or alternatively, a database may be maintained that specifies where temperature sensors are placed. This database may be referenced by installers and may allow for accurate remote processing of the temperature data. The database may be used for both air handler sensors and compressor/condenser sensors. The database may be prepopulated by the monitoring company or may be developed by trusted installers, and then shared with other installation contractors.

As described above, the condensing monitor module 204 may communicate with the air handler monitor module 200 over one or more control lines from the thermostat 208. In these implementations, data from the condensing monitor module 204 is transmitted to the air handler monitor module 200, which in turn uploads the data over the Internet 248.

In various implementations, the transformer 260 may be omitted, and the condensing monitor module 204 may include a power supply that is directly powered by the incoming AC power. Further, power-line communications may be conducted over the AC power line instead of over a lower-voltage HVAC control line.

Figure 2C:
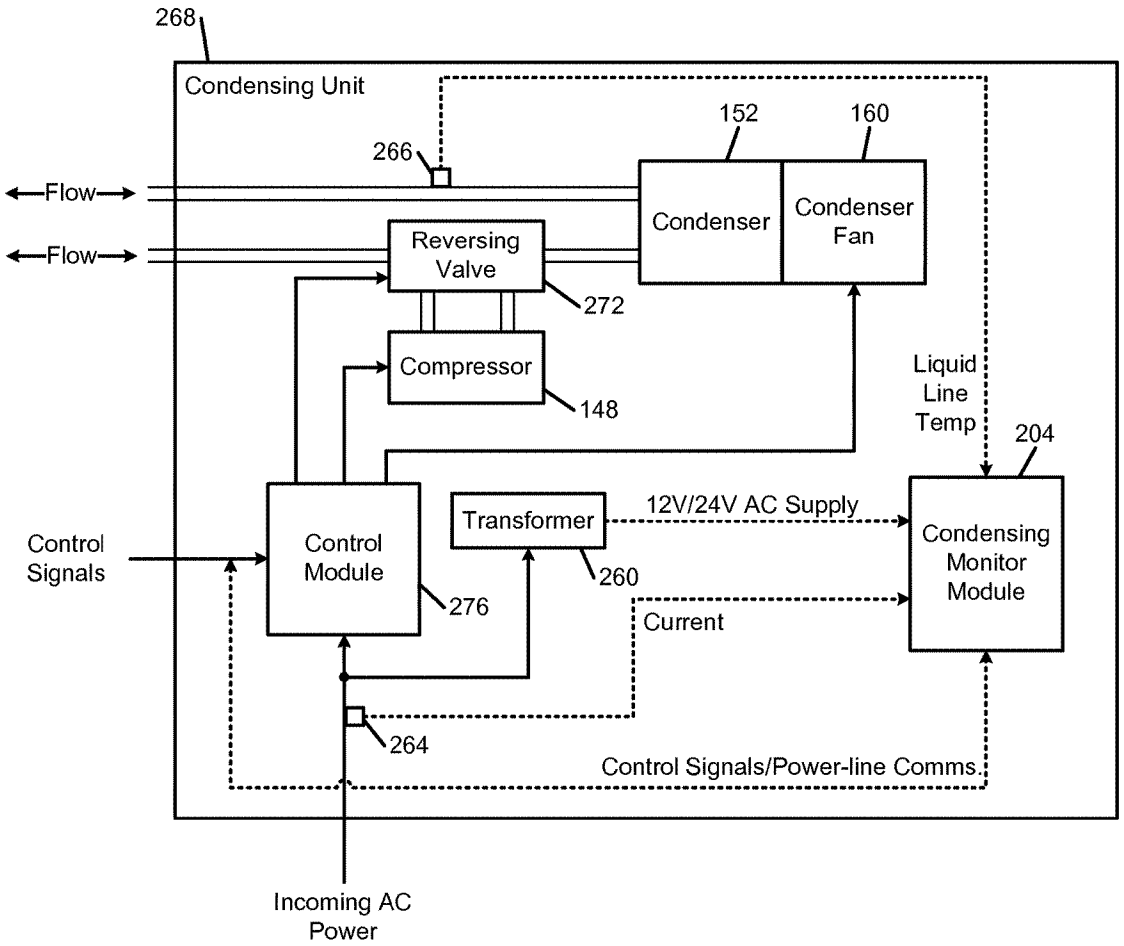
FIG. 2C is a functional block diagram of an example HVAC system based on a heat pump.

In FIG. 2C, an example condensing unit 268 is shown for a heat pump implementation. The condensing unit 268 may be configured similarly to the condensing unit 164 of FIG. 2B. Similarly to FIG. 2B, the transformer 260 may be omitted in various implementations. Although referred to as the condensing unit 268, the mode of the heat pump determines whether the condenser 152 of the condensing unit 268 is actually operating as a condenser or as an evaporator. A reversing valve 272 is controlled by a control module 276 and determines whether the compressor 148 discharges compressed refrigerant toward the condenser 152 (cooling mode) or away from the condenser 152 (heating mode).

Figure 3:
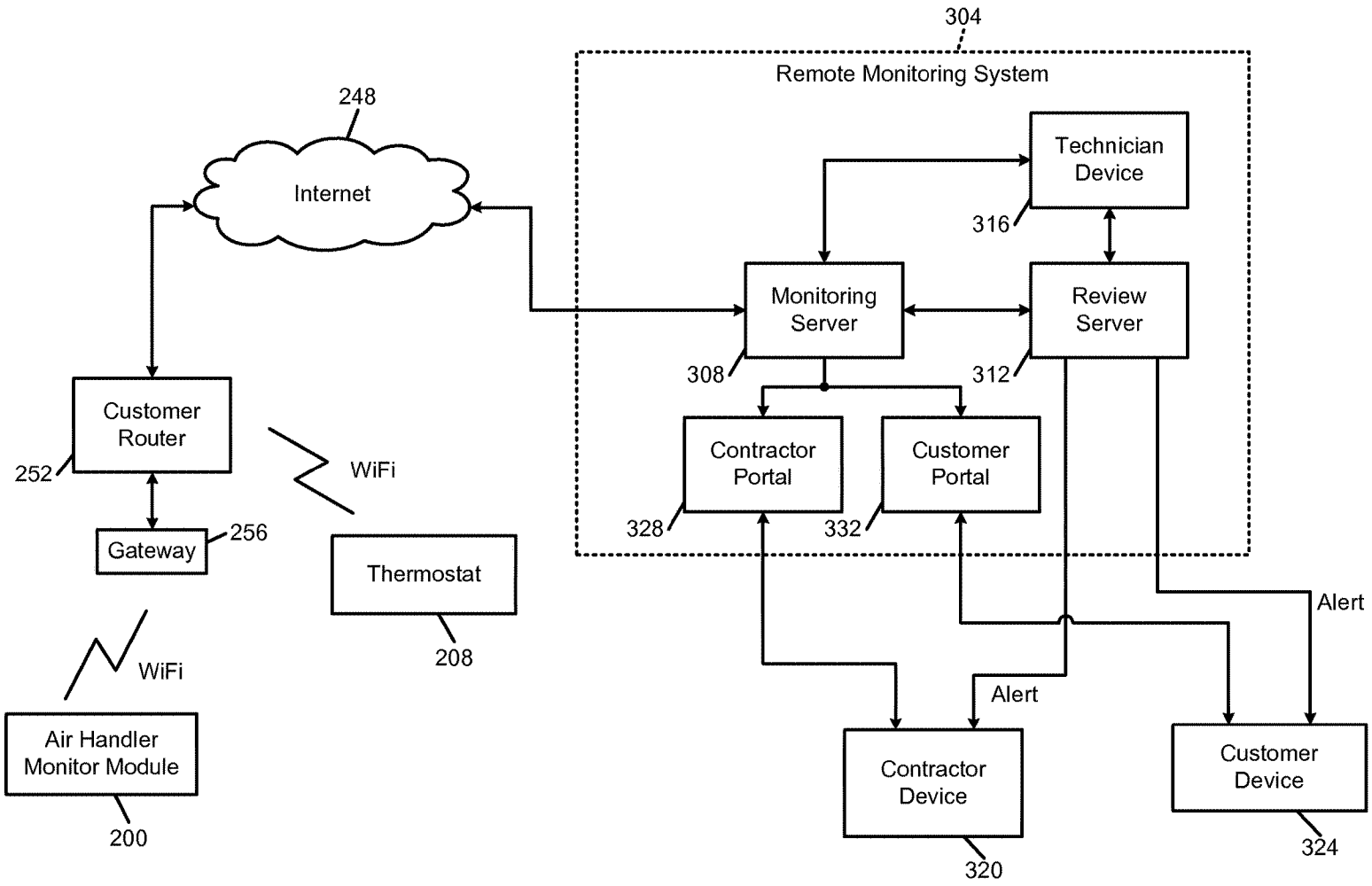
FIG. 3 is a high level functional block diagram of an example system including an implementation of a remote monitoring system.

In FIG. 3, the air handler monitor module 200 and the thermostat 208 are shown communicating, using the customer router 252, with a remote monitoring system 304 via the Internet 248. In other implementations, the condensing monitor module 204 may transmit data from the air handler monitor module 200 and the condensing monitor module 204 to an external wireless receiver. The external wireless receiver may be a proprietary receiver for a neighborhood in which the building is located, or may be an infrastructure receiver, such as a metropolitan area network (such as WiMAX), a WiFi access point, or a mobile phone base station.

The remote monitoring system 304 includes a monitoring server 308 that receives data from the air handler monitor module 200 and the thermostat 208 and maintains and verifies network continuity with the air handler monitor module 200. The monitoring server 308 executes various algorithms to identify problems, such as failures or decreased efficiency, and to predict impending faults.

The monitoring server 308 may notify a review server 312 when a problem is identified or a fault is predicted. This programmatic assessment may be referred to as an advisory. Some or all advisories may be triaged by a technician to reduce false positives and potentially supplement or modify data corresponding to the advisory. For example, a technician device 316 operated by a technician is used to review the advisory and to monitor data (in various implementations, in real-time) from the air handler monitor module 200 via the monitoring server 308.

The technician using the technician device 316 reviews the advisory. If the technician determines that the problem or fault is either already present or impending, the technician instructs the review server 312 to send an alert to either or both of a contractor device 320 or a customer device 324. The technician may determine that, although a problem or fault is present, the cause is more likely to be something different than specified by the automated advisory. The technician can therefore issue a different alert or modify the advisory before issuing an alert based on the advisory. The technician may also annotate the alert sent to the contractor device 320 and/or the customer device 324 with additional information that may be helpful in identifying the urgency of addressing the alert and presenting data that may be useful for diagnosis or troubleshooting.

In various implementations, minor problems may be reported to the contractor device 320 only so as not to alarm the customer or inundate the customer with alerts. Whether the problem is considered to be minor may be based on a threshold. For example, an efficiency decrease greater than a predetermined threshold may be reported to both the contractor and the customer, while an efficiency decrease less than the predetermined threshold is reported to only the contractor.

In some circumstances, the technician may determine that an alert is not warranted based on the advisory. The advisory may be stored for future use, for reporting purposes, and/or for adaptive learning of advisory algorithms and thresholds. In various implementations, a majority of generated advisories may be closed by the technician without sending an alert.

Based on data collected from advisories and alerts, certain alerts may be automated. For example, analyzing data over time may indicate that whether a certain alert is sent by a technician in response to a certain advisory depends on whether a data value is on one side of a threshold or another. A heuristic can then be developed that allows those advisories to be handled automatically without technician review. Based on other data, it may be determined that certain automatic alerts had a false positive rate over a threshold. These alerts may be put back under the control of a technician.

In various implementations, the technician device 316 may be remote from the remote monitoring system 304 but connected via a wide area network. For example only, the technician device 316 may include a computing device such as a laptop, desktop, or tablet.

With the contractor device 320, the contractor can access a contractor portal 328, which provides historical and real-time data from the air handler monitor module 200. The contractor using the contractor device 320 may also contact the technician using the technician device 316. The customer using the customer device 324 may access a customer portal 332 in which a graphical view of the system status as well as alert information is shown. The contractor portal 328 and the customer portal 332 may be implemented in a variety of ways according to the present disclosure, including as an interactive web page, a computer application, and/or an app for a smartphone or tablet.

In various implementations, data shown by the customer portal may be more limited and/or more delayed when compared to data visible in the contractor portal 328. In various implementations, the contractor device 320 can be used to request data from the air handler monitor module 200, such as when commissioning a new installation.

Figure 4A:
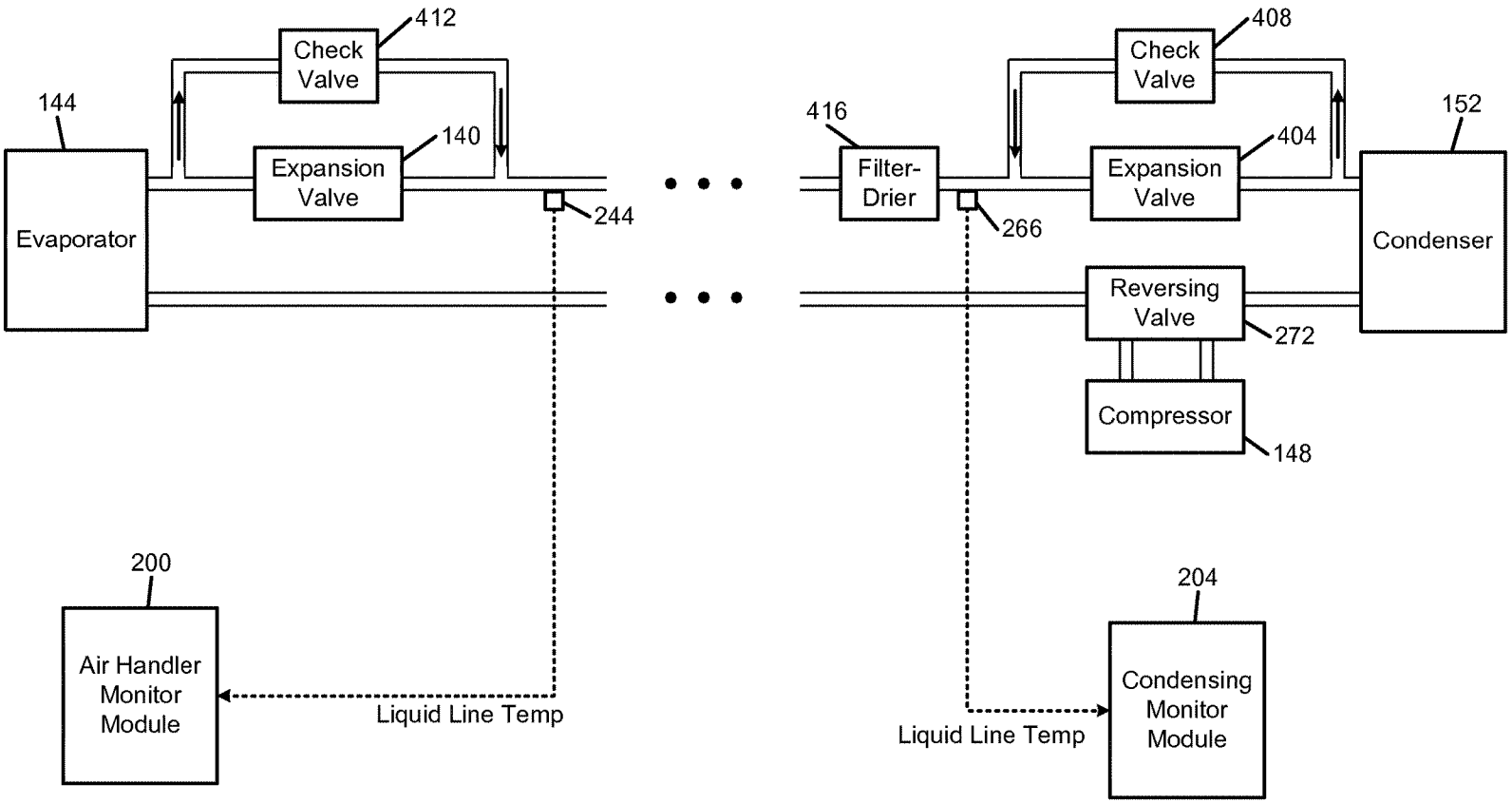
FIGS. 4A-4C are functional block diagrams of example heat pump implementations including sensors for monitoring refrigerant line restrictions according to the principles of the present disclosure.

In FIG. 4A, additional detail for a heat pump system is shown. While FIG. 2C showed the addition of the reversing valve 272, additional differences between a standard split air conditioning system and a heat pump system may be present. For example only, an additional expansion valve 404 may be located close to the condenser 152.

Note that in the heat pump system, the function of the condenser 152 and the evaporator 144 change depending on the mode of operation. In heating mode, the evaporator 144 actually functions as a condensing coil while the condenser 152 operates as an evaporating coil. For simplicity of explanation however, the evaporator 144 and the condenser 152 will be referred to with names corresponding to their functionality in cooling mode.

In cooling mode, the expansion valve 140 allows refrigerant to expand prior to reaching the evaporator 144. Meanwhile, in heating mode, the expansion valve 404 allows the refrigerant to expand prior to reaching the condenser 152 (once again, note that in heating mode, the condenser 152 will be operating as the evaporating coil).

In order to prevent the expansion valve 404 from operating on the refrigerant during cooling mode, a check valve 408 allows refrigerant to bypass the expansion valve 404 in the cooling mode. Similarly, a check valve 412 allows refrigerant to bypass the expansion valve 140 during heating mode. A bidirectional filter-drier 416 is located in series with the refrigerant line.

Although shown in FIG. 4A as being associated with the condensing unit 268, the filter-drier 416 may instead be associated with the air handler unit 136 or at some location along the refrigerant line in between the units, such as in a refrigerant line external to the building being serviced by the HVAC system. In various implementations, the filter-drier 416 may be located exterior to the building so that service can be performed such as replacing the filter-drier 416 without having to enter the building.

The liquid line temperature sensor 244 measures a temperature of refrigerant in the liquid line and provides the measured temperature to the air handler monitor module 200. Similarly, the liquid line temperature sensor 266 measures a temperature of the refrigerant and provides the measurement to the condensing monitor module 204.

In various implementations, the liquid line temperature sensor 244 may instead be located near the condensing unit 268 and provide the measurement to the condensing monitor module 204 (not shown). Alternatively, when the filter-drier 416 is located closer to the air handler unit 136, the liquid line temperature sensor 266 may provide measurements to the air handler monitor module 200 (such as is shown by the liquid line temperate sensor 246 in FIG. 2A).

If the filter-drier 416 becomes plugged, such as when its absorption capacity for contaminants is reached, the filter-drier 416 may begin to act like an unintended expansion valve. During heating mode, refrigerant is circulating in FIG. 4A from right to left across the filter-drier 416. If the filter-drier 416 is acting as an expansion valve, the temperature measured by the liquid line temperature sensor 244 will be much lower than normal.

Similarly, in heating mode, if the filter-drier 416 is acting as an expansion valve, the temperature measured by the liquid line temperature sensor 266 will be lower than normal. Other restrictions in the refrigerant line, including restrictions in the check valves 408 and 412, may produce similar results that are measureable by the liquid line temperature sensors 244 and/or 266.

Figure 4B:
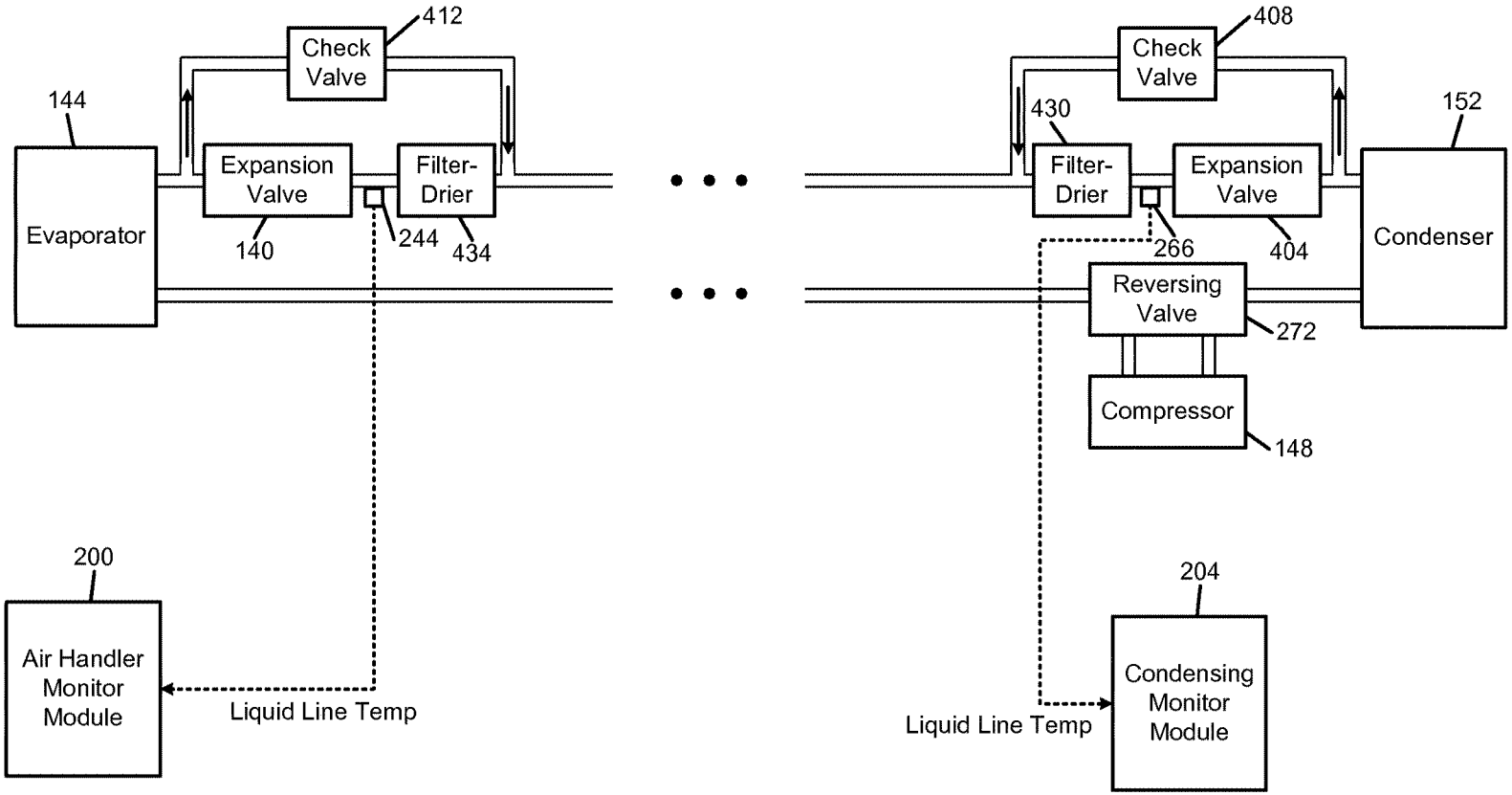

In FIG. 4B, another example implementation of a heat pump system is shown. Here, a first filter-drier 430 is associated with the heating mode while a second filter-drier 434 is associated with the cooling mode. The check valve 408 allows refrigerant to bypass both the filter-drier 430 and the expansion valve 404 during cooling mode. The check valve 412 allows refrigerant to bypass the expansion valve 140 and the filter-drier 434 during heating mode.

The liquid line temperature sensor 266 is therefore located downstream (with respect to the flow of the refrigerant during heating mode) of the filter-drier 430. As a result, the liquid line temperature sensor 266 will detect a decrease in temperature if the filter-drier 430 is operating as an unintended expansion valve. Similarly, the liquid line temperature sensor 244 is located downstream (with respect to the direction the refrigerant will flow when the filter-drier 434 is in use—i.e., in cooling mode) of the filter-drier 434.

Figure 4C:
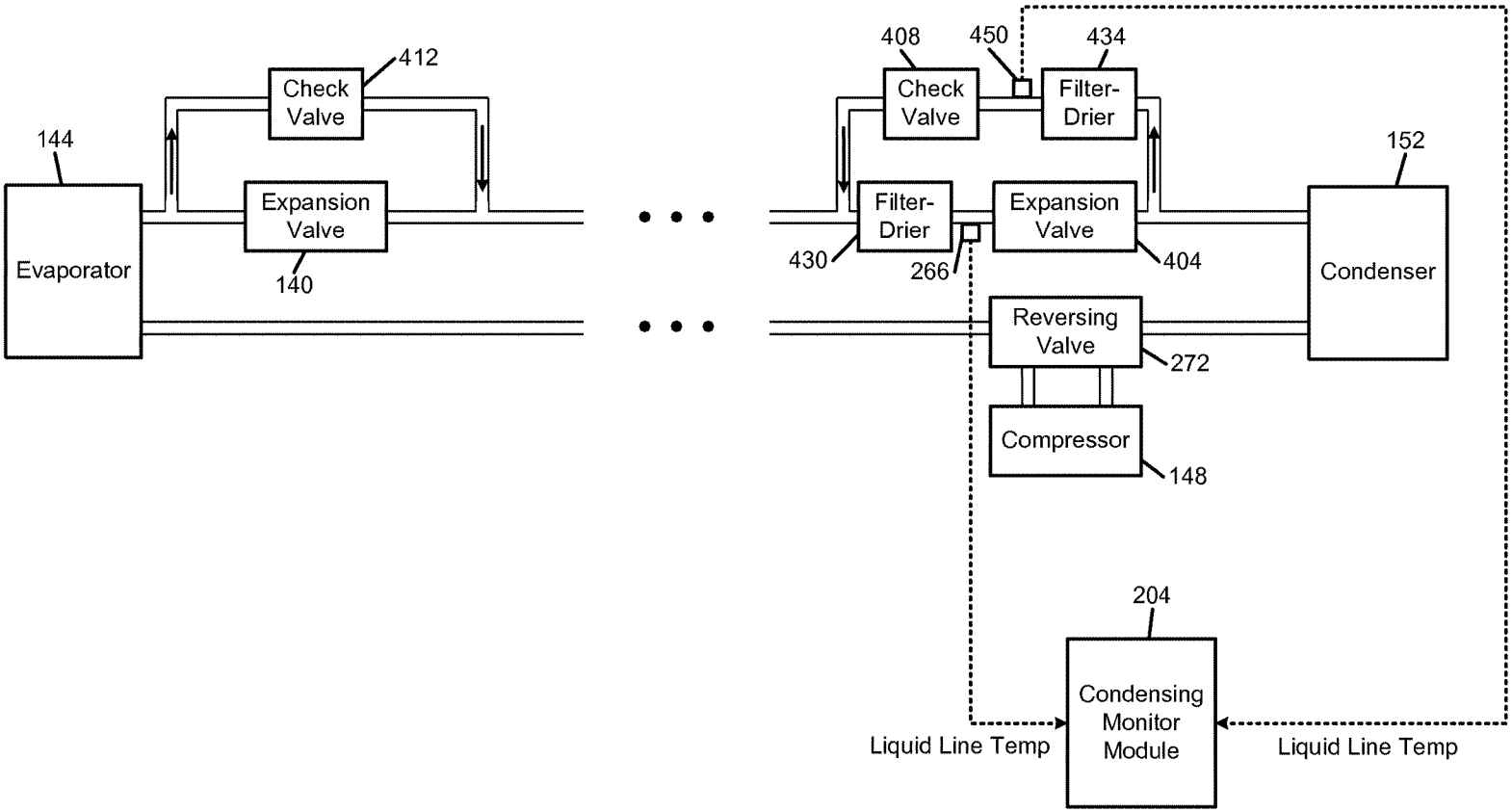

In FIG. 4C, the filter-drier 434 is located in series with the check valve 408. During cooling mode, refrigerant cycles from the condenser 152 through the filter-drier 434, the check valve 408, and the expansion valve 140 before reaching the evaporator 144. Note that, if a restriction in the filter-drier 434 is severe enough, some refrigerant may instead flow through the expansion valve 404. This may be detected as a drop in temperature by the liquid line temperature sensor 266.

Undesirable operation of the filter-drier 434 as an expansion valve can be measured by a liquid line temperature sensor 450, which is located subsequent to the filter-drier 434 and provides measurements to the condensing monitor module 204. Although shown between the check valve 408 and the filter-drier 434, the liquid line temperature sensor 450 may be located at other positions after the filter-drier 434 but before the expansion valve 140. In various implementations, the liquid line temperature sensor 450 may report temperature readings to the air handler monitor module 200.

Figure 5:
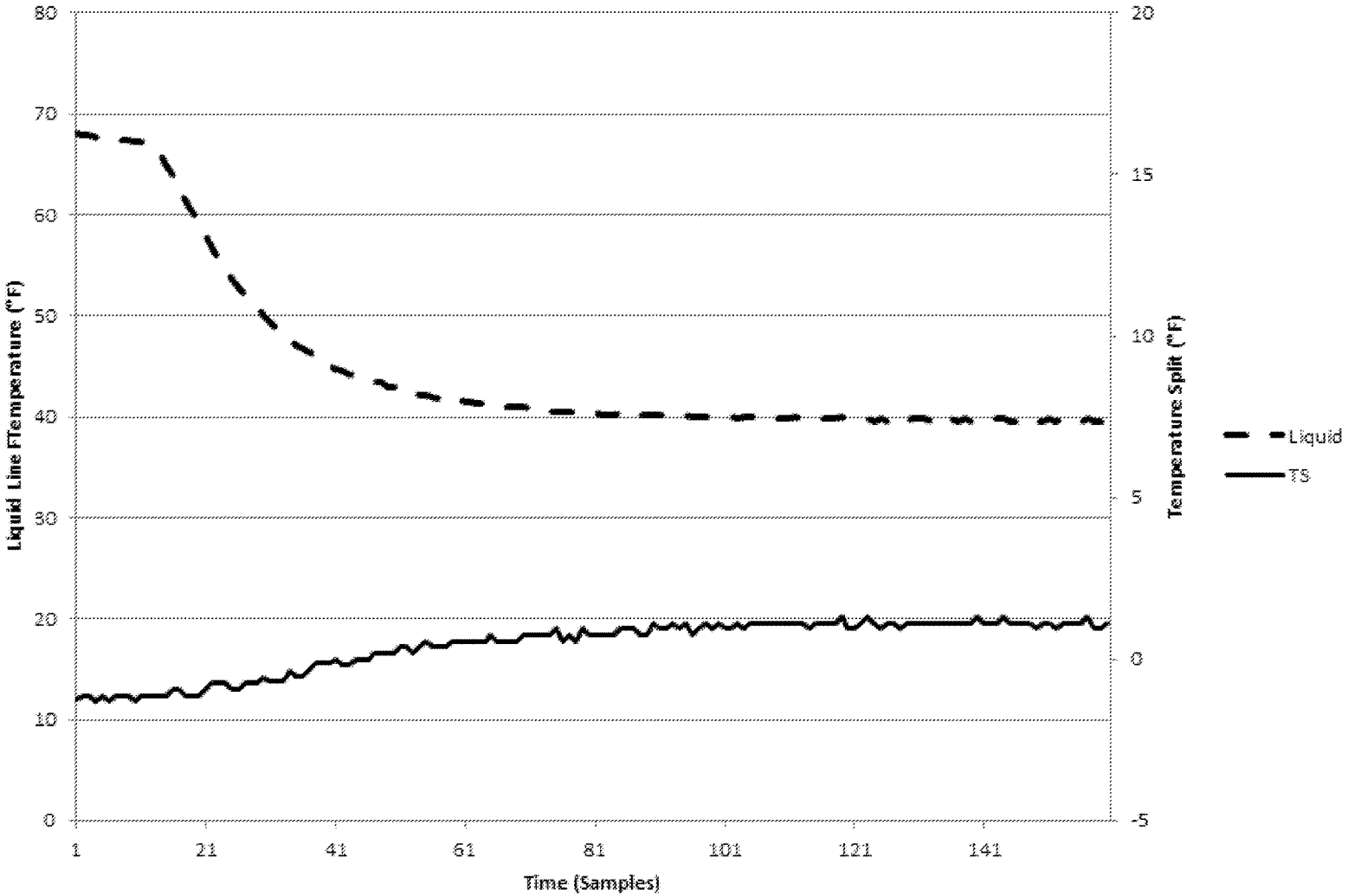
FIG. 5 is an example plot of liquid line temperature and temperature split versus time in the presence of a restriction in the refrigerant line.

FIG. 5 is an example plot of liquid line temperature and temperature split (TS) versus time. The temperature split in this example is the difference in temperature between return air (generally, the air entering the evaporator) and supply air (generally, the air leaving the evaporator). The time axis is shown, for example only, in units of samples, where there are 7.5 samples per second. The vertical axis for the liquid line temperature is in degrees Fahrenheit and is shown at the left of the plot. The vertical axis for the temperature split is also in degrees Fahrenheit but is on a different scale, shown at the right of the plot.

In FIG. 5, a restriction event (such as blockage of a filter-drier) has occurred. When the system starts (sample 0 in the plot), the liquid line temperature drops because of expansion of the now-compressed refrigerant. This is accompanied by only a trivial increase in temperature split (TS). Without more information, the lack of significant change in the temperature split may be a result of a variety of faults. The drop in liquid line temperature may allow a more specific diagnosis that the fault is likely to be due to a liquid line restriction upstream of the liquid line temperature sensor.

Figure 6A:
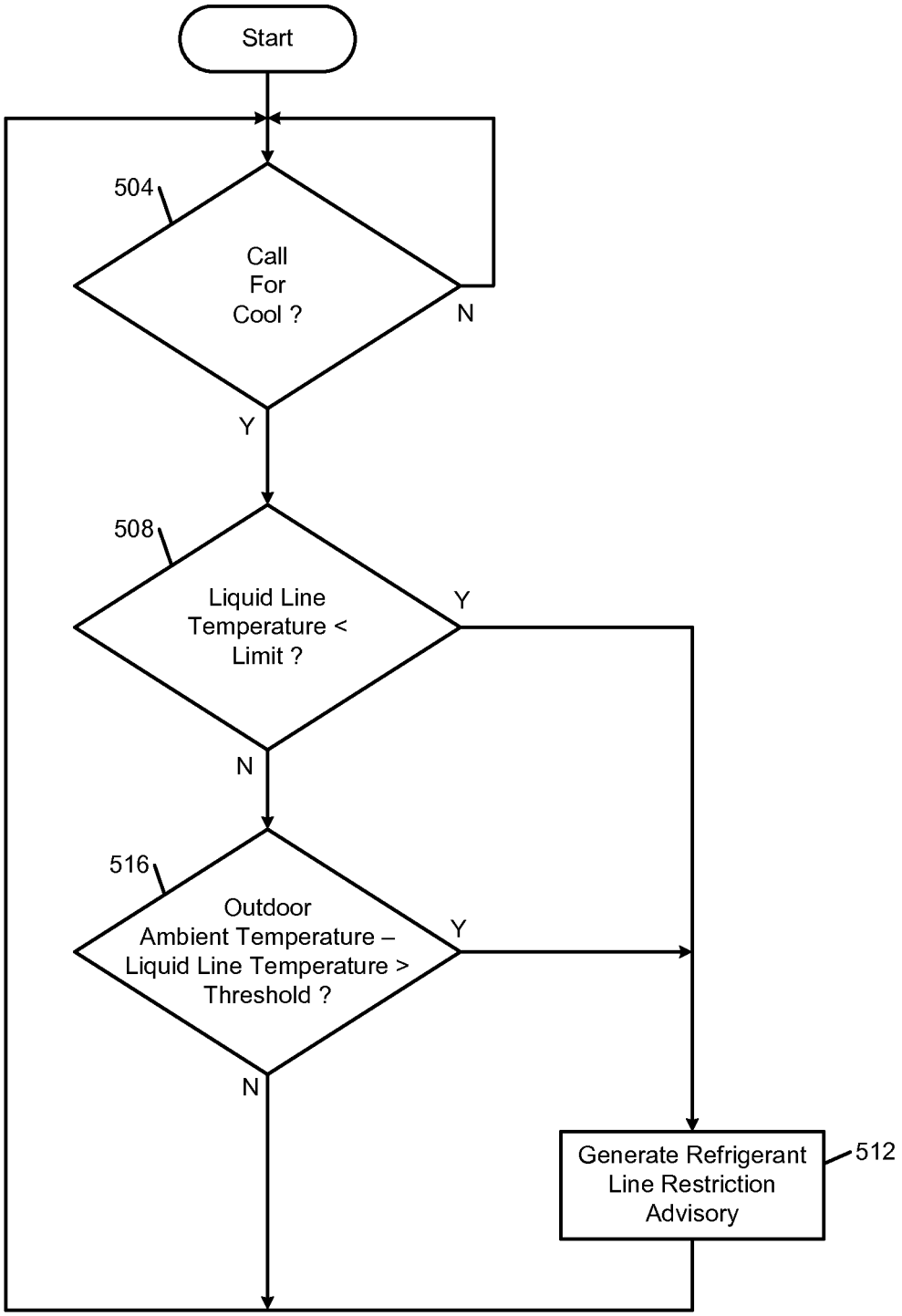
FIG. 6A is a flowchart of an example monitoring operation for an air conditioning system based on a single liquid line temperature sensor.

In FIG. 6A, control for a split air conditioning system with a single liquid line temperature sensor begins at 504. If a call for cool is present, control transfers to 508; otherwise, control remains at 504. At 508, if the liquid line temperature is less than an absolute limit, control transfers to 512; otherwise, control transfers to 516.

At 512, a refrigerant line restriction advisory is generated, indicating that a fault is present and is likely caused by a restriction in the refrigerant line. This advisory, as described above, can then be triaged with an automated and/or manual process before resulting in an alert that is sent to a customer and/or contractor. Control then returns to 504.

At 516, control determines whether an outdoor ambient temperature minus the liquid line temperature is greater than the threshold. If so, control transfers to 512; otherwise, control returns to 504. If so, control transfers to 512; otherwise, control returns to 504. Alternatively, the test of 516 can be expressed as whether the liquid line temperature is less than an adaptive threshold, where the adaptive threshold is equal to the outdoor ambient temperature minus a predetermined threshold value.

As discussed above, the outdoor ambient temperature may be measured by a temperature sensor associated with the condensing unit 164. Alternatively, ambient temperature may be acquired from other data sources such as from geographically-based weather data.

The condenser is designed to bring the temperature of the refrigerant as close as possible to the outside ambient temperature. Therefore, when the difference between these temperatures increases, a fault is likely present. As described above, when the liquid line temperature decrease significantly, that fault may be caused by a restriction in the liquid line prior to the liquid line temperature sensor, such as may be caused by blockage of a filter-drier.

Figure 6B:
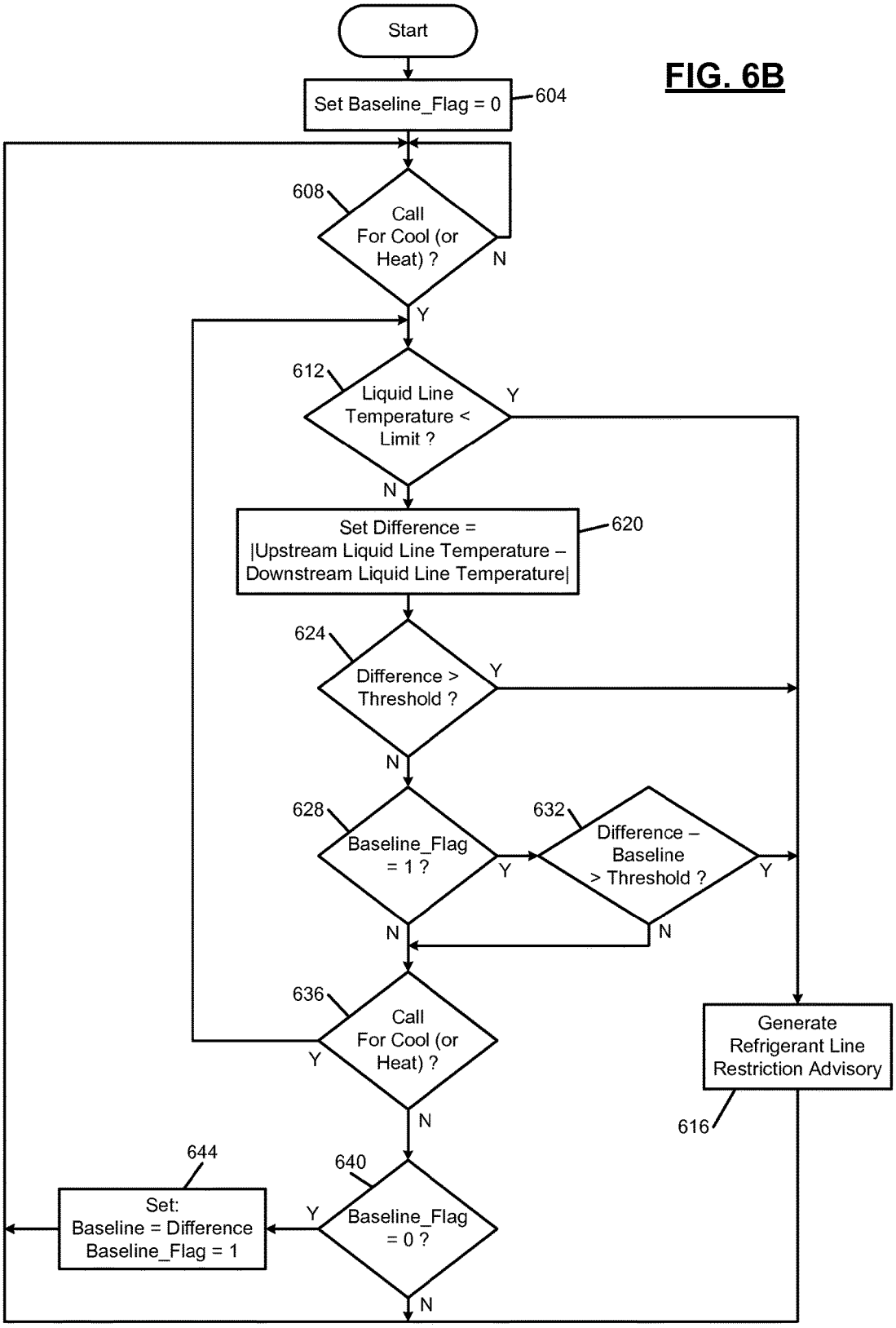
FIG. 6B is a flowchart of an example monitoring operation for an air conditioning system with two sensors or a heat pump with a single-bidirectional filter-drier.

In FIG. 6B, monitoring operation for a 2 sensor system with a single filter-drier begins at 604. The single filter-drier may be present in an air conditioning system or in a heat pump system. When the single filter-drier is in a heat pump system, the single filter-drier may be bidirectional. At 604, control sets a baseline flag equal to zero. This indicates that a baseline has not yet been established for a parameter of interest—in this case, a temperature difference. Later in FIG. 6B, a baseline is established and the flag is therefore changed to one.

The baseline flag may be set to zero at 604 the first time the system receives power, such as upon commissioning of a new HVAC system. In addition, after servicing of the HVAC system, control may begin anew at 604 to establish a new baseline. After 604, control proceeds to 608, where control determines whether a call for cool is present. If so, control transfers to 612; otherwise, control remains at 608. For a heat pump system, the call for cool may also be a call for heat. Therefore, in a heat pump system, if there is a call for either heat or cool, control will transfer to 612.

At 612, control determines whether the liquid line temperature is less than a predetermined absolute limit. If so, control transfers to 616; otherwise, control continues at 620. At 616, an advisory indicating a potential refrigerant line restriction is generated, and control returns to 608. The liquid line temperature is determined from the liquid line temperature sensor that is downstream (with respect to the flow of refrigerant for the selected mode of operation) of the filter-drier. In a split air conditioning system, the only mode is cooling and the liquid line temperature sensor relied on in 612 will therefore be located between the filter-drier and the expansion valve (such as is shown in FIG. 2A at 244).

At 620, control sets a "difference" variable to an absolute value of the difference between an upstream liquid line temperature and a downstream liquid line temperature. In a split air conditioning system, the upstream liquid line temperature sensor will generally be an outdoor liquid line temperature sensor (such as shown in FIG. 2B at 266 or in FIG. 2A at 246) and the downstream liquid line temperature sensor will be the liquid line temperature sensor between the filter-drier and the expansion valve (such as FIG. 2A at 244).

Control continues at 624, where if the difference variable is greater than a predetermined threshold, control transfers to 616; otherwise, control transfers to 628. This predetermined threshold may be set as an upper limit such that if the difference is greater than that upper limit, a fault is very likely to be occurring regardless of the normal operating parameters of the system. Meanwhile, a baseline is established to provide finer-grained detection of faults based on normal operation of the system.

At 628, control determines whether the baseline flag is equal to one. If so, a baseline has been established and control continues at 632; otherwise, control transfers to 636. At 632, control determines whether the difference variable exceeds the baseline by more than the threshold. If so, control transfers to 616 to generate an advisory; otherwise, control transfers to 636. This test can alternatively be phrased as whether the difference variable exceeds a threshold that is equal to the baseline plus a predetermined static value.

The inequality of 632 can be expanded to two inequalities by removing the absolute value operation as follows: (i) is the upstream liquid line temperature−the downstream liquid line temperature−the baseline >a predefined threshold or (ii) is the downstream liquid line temperature−the upstream liquid line temperature−the baseline >a predefined threshold. This can be alternatively expressed as: (i) is the downstream liquid line temperature less than a first adaptive threshold, where the first adaptive threshold is equal to the upstream liquid line temperature−the baseline−the predefined threshold value or (ii) is the downstream liquid line temperature greater than a second adaptive threshold, where the second adaptive threshold is equal to the upstream liquid line temperature plus the baseline plus the predefined threshold value.

At 636, control determines whether the call for heat or cool is still present. If so, control returns to 612; otherwise, the call has ended and control transfers to 640. At 640, control determines whether the baseline flag is still equal to zero. If so, control transfers to 644; otherwise, control returns to 608. At 644, a baseline has not yet been established so the baseline is set equal to the difference. This difference represents the difference between the upstream and downstream liquid line temperatures at the end of the run. The end of the run is chosen in this implementation because during the beginning of a run, the difference may not have yet assumed a steady state. The baseline flag is then set equal to one to indicate that the baseline has been established. Control then returns to 608.

Figure 6C:
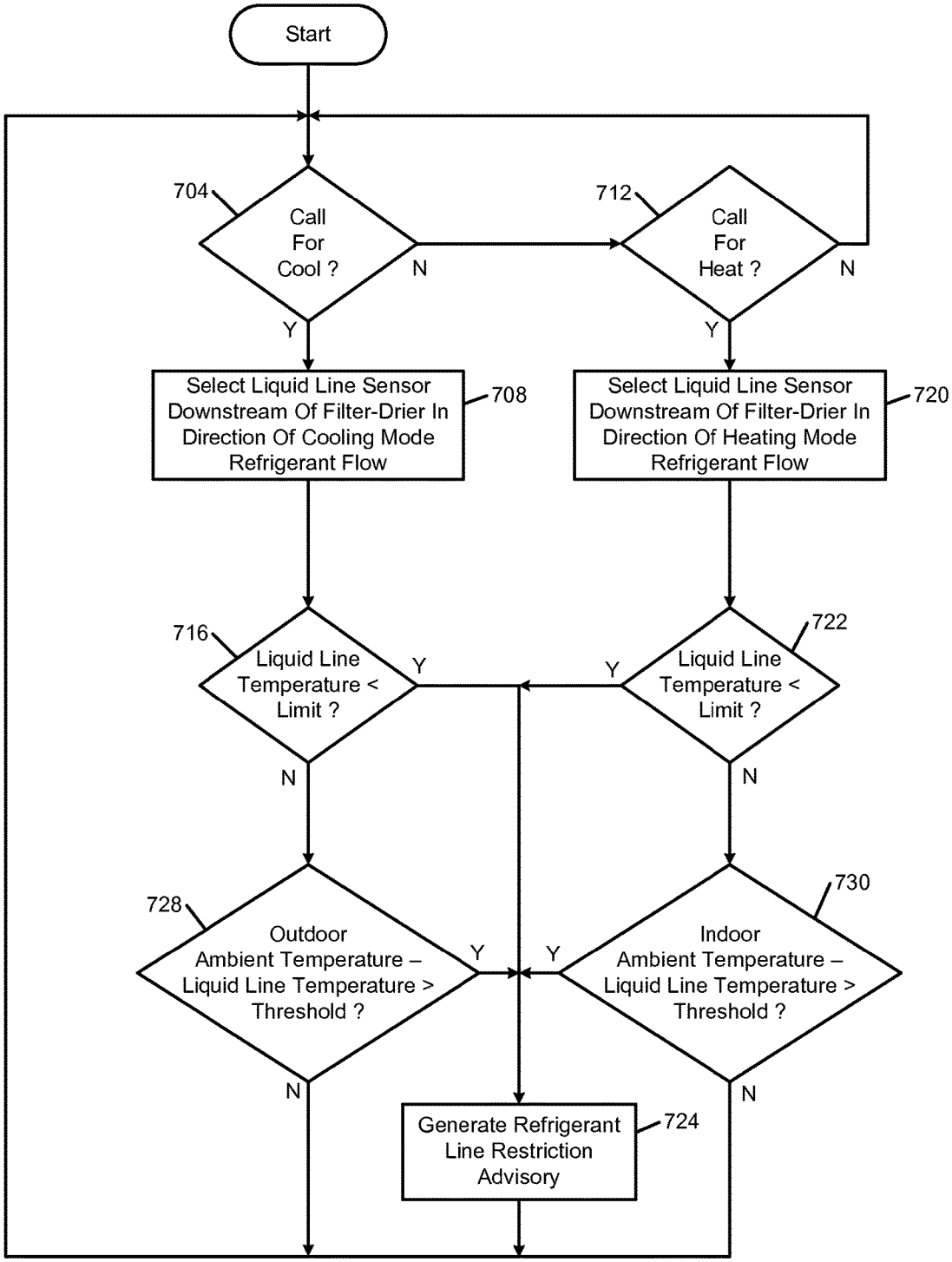
FIG. 6C is a flowchart of an example monitoring operation for a heat pump having multiple filter-driers.

In FIG. 6C, monitoring operation for a heat pump with multiple filter-driers begins at 704. If a call for cool is present, control transfers to 708; otherwise, control transfers to 712. At 708, control selects the liquid line sensor that is downstream of the filter-drier in the direction of refrigerant flow for the cooling mode. The temperature from this liquid line sensor is then used to determine whether a liquid line restriction is present. Control continues at 716.

Returning to 712, control determines whether a call for heat is present. If so, control transfers to 720; otherwise, control returns to 704. At 720, control selects the liquid line sensor that is downstream of the filter-drier in the direction of refrigerant flow for the heating mode. The temperature from this liquid line sensor is then used for determination of a potential restriction in the refrigerant line. Control continues at 722.

At 716, control determines whether the liquid line temperature is less than a predetermined limit. If so, control transfers to 724; otherwise, control continues at 728. At 724, control generates an advisory indicating a potential refrigerant line restriction and returns to 704. At 728, control determines whether a difference between the outdoor ambient temperature and the liquid line temperature is greater than a predetermined threshold. If so, control transfers to 724; otherwise, control returns to 704. Note that the inequality in 728 can be expressed as the liquid line temperature being less than an adaptive threshold, where the adaptive threshold is the difference between the outdoor ambient temperature and a predefined value.

At 722, control determines whether the liquid line temperature is less than a predetermined limit. If so, control transfers to 724; otherwise, control continues at 730. The predetermined limit may be the same as, or different than, the predetermined limit of 716. At 730, control determines whether a difference between the indoor ambient temperature (for example, the return air temperature or conditioned space temperature) and the liquid line temperature is greater than a predetermined threshold. If so, control transfers to 724; otherwise, control returns to 704. Note that the inequality in 730 can be expressed as the liquid line temperature being less than an adaptive threshold, where the adaptive threshold is the difference between the indoor ambient temperature and a predefined value.

Note that, in heating mode, the ambient temperature is the indoor ambient temperature, while in cooling mode the ambient temperature is the outdoor ambient temperature. In other words, the ambient temperature is the temperature the refrigerant should assume after passing through the coil that is presently operating as the condensing coil. Significant deviation from this ambient temperature indicates a fault.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules.

The term memory is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory (such as flash memory), volatile memory (such as static random access memory and dynamic random access memory), magnetic storage (such as magnetic tape or hard disk drive), and optical storage.

The apparatuses and methods described in this application may be partially or fully implemented by one or more computer programs executed by one or more processors. The computer programs include processor-executable instructions that are stored on at least one non-transitory, tangible computer-readable medium. The computer programs may also include and/or rely on stored data.

What is claimed is:

1. A monitoring system for a heating, ventilation, and air conditioning (HVAC) system of a building, the HVAC system including a refrigerant loop, the monitoring system comprising:

a monitoring device installed at the building, wherein the monitoring device is configured to measure a first temperature of refrigerant in a refrigerant line located between a filter-drier of the refrigerant loop and an expansion valve of the refrigerant loop; and a monitoring server, located remotely from the building, configured to:

receive the first temperature, in response to the first temperature being less than a threshold, generate a refrigerant line restriction advisory, and in response to the refrigerant line restriction advisory, selectively generate an alert for transmission to at least one of a customer and an HVAC contractor.

2. The monitoring system of claim 1 wherein the threshold is a predefined value.

3. The monitoring system of claim 1 wherein the threshold is based on an ambient temperature.

4. The monitoring system of claim 3 wherein while the HVAC system is in a cooling mode, the ambient temperature is an outside ambient temperature.

5. The monitoring system of claim 3 wherein the threshold is determined by subtracting a predetermined value from the ambient temperature.

6. The monitoring system of claim 3 wherein the monitoring server is further configured to generate the refrigerant line restriction advisory in response to the first temperature being less than a second threshold, wherein the second threshold is a predefined value.

7. The monitoring system of claim 3 wherein the HVAC system comprises a heat pump system, and wherein the ambient temperature is an indoor ambient temperature while the HVAC system is in a heating mode.

8. The monitoring system of claim 1 wherein the threshold is based on a second temperature of refrigerant at a location upstream of the filter-drier in the refrigerant loop.

9. The monitoring system of claim 8 wherein the monitoring server is further configured to generate the refrigerant line restriction advisory in response to a difference between the first temperature and the second temperature exceeding a second threshold.

10. The monitoring system of claim 9 wherein a baseline value for the difference is established and the second threshold is determined based on the baseline value.

11. The monitoring system of claim 10 wherein the second threshold is equal to the baseline value plus a predetermined value.

12. The monitoring system of claim 1 wherein the alert indicates that a refrigerant line restriction has been detected.

13. A method of monitoring a heating, ventilation, and air conditioning (HVAC) system of a building, the HVAC system including a refrigerant loop, the method comprising:

measuring a first temperature of refrigerant in a refrigerant line located between a filter-drier of the refrigerant loop and an expansion valve of the refrigerant loop;

transmitting the first temperature to a server located remotely from the building;

at the server, comparing the first temperature to a threshold;

in response to the first temperature being less than the threshold, generating a refrigerant line restriction advisory; and in response to the refrigerant line restriction advisory, selectively generating an alert for transmission to at least one of a customer and an HVAC contractor.

14. The method of claim 13 wherein the threshold is a predefined value.

15. The method of claim 13 wherein the threshold is based on an ambient temperature.

16. The method of claim 15 wherein while the HVAC system is in a cooling mode, the ambient temperature is an outside ambient temperature.

17. The method of claim 15 wherein the threshold is determined by subtracting a predetermined value from the ambient temperature.

18. The method of claim 15 further comprising generating the refrigerant line restriction advisory in response to the first temperature being less than a second threshold, wherein the second threshold is a predefined value.

19. The method of claim 15 wherein the HVAC system comprises a heat pump system, and wherein the ambient temperature is an indoor ambient temperature while the HVAC system is in a heating mode.

20. The method of claim 13 wherein the threshold is based on a second temperature of refrigerant at a location upstream of the filter-drier in the refrigerant loop.

21. The method of claim 20 further comprising generating the refrigerant line restriction advisory in response to a difference between the first temperature and the second temperature exceeding a second threshold.

22. The method of claim 21 further comprising:

establishing a baseline value for the difference; and determining the second threshold based on the baseline value.

23. The method of claim 22 wherein the second threshold is equal to the baseline value plus a predetermined value.

24. The method of claim 13 wherein the alert indicates that a refrigerant line restriction has been detected.

25. A method of monitoring a heating, ventilation, and air conditioning (HVAC) system of a building, the HVAC system including a refrigerant loop, the method comprising:

at a monitoring server remote from the building, receiving a first refrigerant temperature, wherein the first refrigerant temperature represents temperature of refrigerant within a refrigerant line located between a filter-drier of the refrigerant loop and an expansion valve of the refrigerant loop;

receiving a second refrigerant temperature at the monitoring server, wherein the second refrigerant temperature represents temperature of refrigerant within a refrigerant line located upstream of the filter-drier of the refrigerant loop;

in response to the first refrigerant temperature being less than a first threshold, generating a first refrigerant line restriction advisory at the monitoring server;

at the monitoring server, calculating a difference between the first refrigerant temperature and the second refrigerant temperature;

at the monitoring server, establishing a baseline value for the difference;

in response to the difference exceeding the baseline value by more than a second threshold, generating a second refrigerant line restriction advisory at the monitoring server; and in response to generation of one or more of the first refrigerant line restriction advisory and the second refrigerant line restriction advisory, selectively generating an alert for transmission to at least one of a customer and an HVAC contractor.

* * * * *